US009892669B2

(12) United States Patent
Heide et al.

(10) Patent No.: US 9,892,669 B2
(45) Date of Patent: Feb. 13, 2018

(54) SUPERRESOLUTION DISPLAY USING CASCADED PANELS

(71) Applicant: NVIDIA Corporation, Santa Clara, CA (US)

(72) Inventors: Felix Heide, Netphen (DE); Douglas Lanman, Sunnyvale, CA (US); Dikpal Reddy, Palo Alto, CA (US); Jan Kautz, Lexington, MA (US); Kari Pulli, Palo Alto, CA (US); David Luebke, Charlottesville, VA (US)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 14/660,030

(22) Filed: Mar. 17, 2015

(65) Prior Publication Data

US 2015/0310789 A1 Oct. 29, 2015

Related U.S. Application Data

(60) Provisional application No. 61/955,057, filed on Mar. 18, 2014.

(51) Int. Cl.

| | |
|---|---|
| ***G09G 3/20*** | (2006.01) |
| ***G09G 3/00*** | (2006.01) |
| ***G09G 3/36*** | (2006.01) |

(52) U.S. Cl.

CPC ..... *G09G 3/20* (2013.01); *G09G 3/007* (2013.01); *G09G 3/36* (2013.01); *G09G 3/2025* (2013.01); *G09G 2300/023* (2013.01); *G09G 2340/0407* (2013.01); *G09G 2340/0435* (2013.01)

(58) Field of Classification Search

CPC ..... H01L 27/3211; H01L 27/1214; G09G 2300/023; G09G 2340/0457; G09G 2340/0407; G09G 2340/12; H04N 19/59

See application file for complete search history.

(56) References Cited

U.S. PATENT DOCUMENTS

| | | | | |
|---|---|---|---|---|
| 2004/0239885 | A1* | 12/2004 | Jaynes | H04N 9/3147 353/30 |
| 2007/0035707 | A1* | 2/2007 | Margulis | G03B 21/26 353/122 |
| 2009/0079667 | A1* | 3/2009 | Schlottmann | G06F 3/1423 345/6 |

(Continued)

FOREIGN PATENT DOCUMENTS

| | | |
|---|---|---|
| CN | 101313595 | 11/2008 |
| CN | 102681239 | 9/2012 |

(Continued)

*Primary Examiner* — Haixia Du

(57) ABSTRACT

System and method of displaying images in spatial/temporal superresolution by multiplicative superposition of cascaded display layers integrated in a display device. Using an original image with a target spatial/temporal resolution as a priori, a factorization process is performed to derive respective image data for presentation on each display layer. The cascaded display layers may be progressive and laterally shifted with each other, resulting in an effective spatial resolution exceeding the native display resolutions of the display layers. Factorized images may be refreshed on respective display layers in synchronization or out of synchronization.

20 Claims, 24 Drawing Sheets

(56) References Cited

U.S. PATENT DOCUMENTS

| | | | | |
|---|---|---|---|---|
| 2011/0149053 | A1* | 6/2011 | Ito | G02B 27/2264 348/56 |
| 2011/0221966 | A1 | 9/2011 | Hsieh et al. | |
| 2011/0310121 | A1 | 12/2011 | Baron | |
| 2012/0293741 | A1* | 11/2012 | Gu | G02F 1/13471 349/61 |
| 2013/0201403 | A1* | 8/2013 | Iversen | G06T 3/0093 348/659 |
| 2014/0184669 | A1* | 7/2014 | Oh | G09G 3/3208 345/694 |
| 2015/0310798 | A1 | 10/2015 | Heide et al. | |

FOREIGN PATENT DOCUMENTS

| | | | |
|---|---|---|---|
| CN | 103338378 | | 10/2013 |
| TW | 545039 | | 8/2003 |
| TW | 200916986 | A | 4/2009 |
| TW | 200939779 | | 9/2009 |
| TW | 201124959 | A | 7/2011 |
| TW | 201210329 | | 3/2012 |
| TW | 201303791 | A | 1/2013 |
| TW | I407226 | B | 9/2013 |

* cited by examiner

100

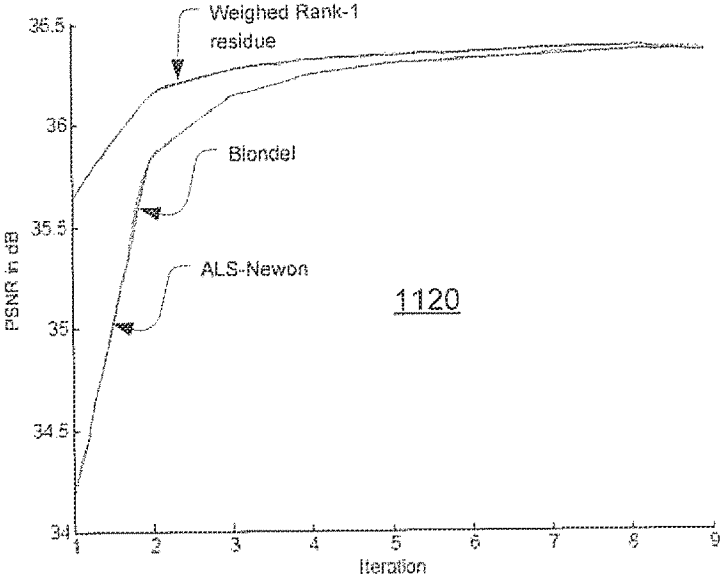
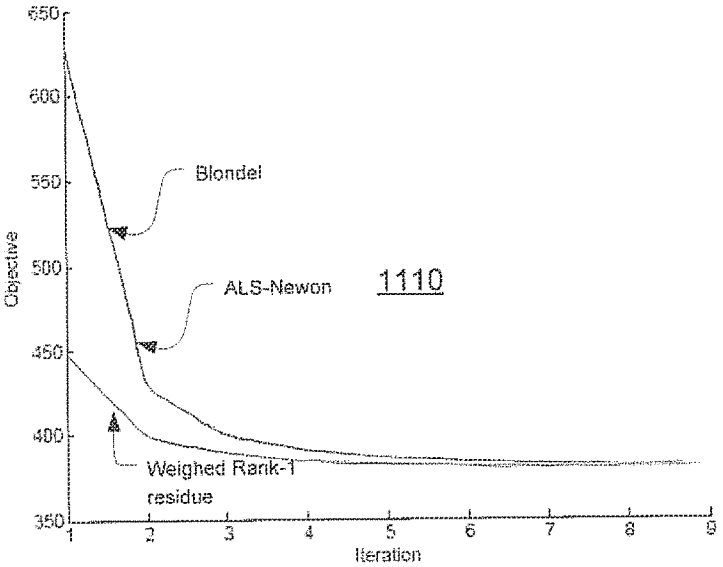
FIG. 11

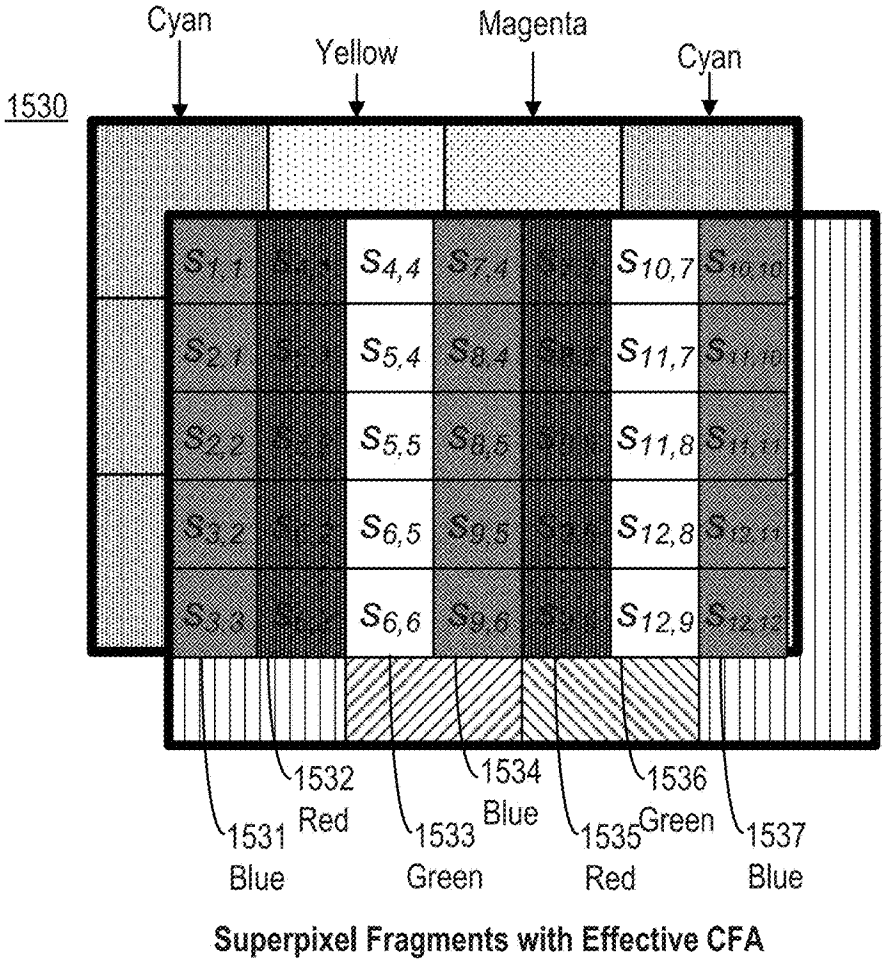
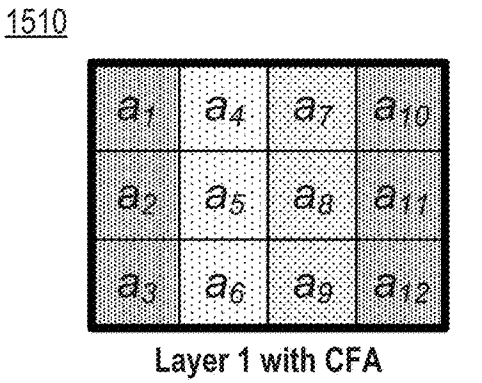
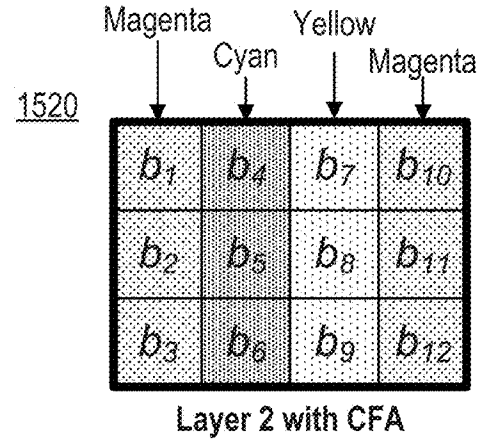
FIG. 15

| | Conventional | Additive (two frames) | Additive (four frames) | OPS (two frames, edge-optimal) | OPS (two frames, edge& smooth optimal) | Cascaded (one frame) | Cascaded (two frames) | Cascaded (three frames) | Cascaded (four frames) | OPS (two frames, edge-optimal, per image) | OPS (two frames, edge & smooth, per image) |
|---|---|---|---|---|---|---|---|---|---|---|---|
| Agama | 29.34 | 35.64 | 46.09 | 33.01 | 36.28 | 35.70 | 49.34 | 69.59 | 90.67 | 33.10 | 36.28 |
| Baba in Nepal | 26.11 | 31.84 | 43.19 | 28.40 | 30.53 | 31.86 | 46.54 | 72.29 | 94.24 | 28.43 | 30.53 |
| Bamberg | 23.81 | 29.80 | 35.36 | 27.49 | 31.20 | 29.94 | 43.21 | 64.70 | 75.53 | 27.64 | 31.20 |
| Bird | 27.66 | 33.65 | 41.48 | 30.80 | 33.81 | 34.02 | 46.70 | 66.60 | 79.41 | 30.85 | 33.81 |
| Drift | 28.06 | 36.44 | 44.98 | 32.99 | 36.51 | 36.61 | 51.28 | 72.51 | 87.37 | 33.04 | 36.51 |
| Farmer | 27.81 | 33.37 | 44.20 | 30.79 | 33.48 | 33.44 | 48.16 | 71.18 | 90.60 | 30.79 | 33.48 |
| Fire | 29.25 | 35.12 | 41.12 | 33.96 | 37.91 | 36.35 | 49.74 | 65.19 | 74.29 | 33.97 | 37.91 |
| Fly | 24.66 | 29.12 | 34.70 | 30.46 | 34.00 | 29.46 | 39.71 | 54.10 | 68.08 | 30.49 | 34.00 |
| Gypful | 31.25 | 37.16 | 44.74 | 38.24 | 44.25 | 37.73 | 51.47 | 68.02 | 80.51 | 38.35 | 44.25 |
| Laser | 31.05 | 35.59 | 45.98 | 34.53 | 36.86 | 36.49 | 53.34 | 79.92 | 94.54 | 34.53 | 36.86 |
| Libelle | 28.09 | 33.77 | 41.42 | 32.74 | 36.49 | 34.02 | 45.57 | 63.69 | 75.56 | 32.75 | 36.49 |
| Painted Ladies | 27.19 | 34.87 | 43.08 | 31.37 | 34.59 | 34.82 | 50.97 | 70.35 | 84.88 | 31.39 | 34.59 |
| Porsche | 25.64 | 31.58 | 35.81 | 30.59 | 34.47 | 31.95 | 45.38 | 64.03 | 78.30 | 30.82 | 34.47 |
| Suzuka | 27.42 | 33.12 | 38.52 | 34.71 | 38.96 | 33.78 | 45.51 | 62.24 | 74.97 | 34.71 | 38.96 |
| Townhall | 24.81 | 30.12 | 36.41 | 30.17 | 33.99 | 30.07 | 42.51 | 66.00 | 85.15 | 30.18 | 33.99 |
| Trapp | 28.18 | 34.89 | 41.78 | 35.95 | 39.18 | 35.72 | 47.84 | 69.62 | 83.74 | 36.00 | 39.18 |
| Vespula | 27.38 | 32.51 | 42.22 | 30.49 | 33.00 | 32.80 | 45.18 | 64.76 | 79.80 | 30.57 | 33.00 |
| Glarus Cow | 25.04 | 29.40 | 37.29 | 27.78 | 30.20 | 29.68 | 42.93 | 66.88 | 80.96 | 27.85 | 30.20 |
| Melinaea | 32.00 | 38.90 | 47.43 | 39.33 | 44.75 | 39.50 | 53.98 | 70.18 | 83.50 | 39.38 | 44.75 |
| Mototaxis | 29.37 | 35.88 | 45.17 | 33.16 | 36.49 | 36.26 | 49.63 | 70.09 | 84.20 | 33.17 | 36.49 |
| **AVG** | **27.71** | **33.64** | **41.55** | **32.35** | **35.85** | **34.01** | **47.45** | **67.60** | **82.32** | **32.40** | **35.85** |

FIG. 19

| | Conventional | Additive (two frames) | Additive (four frames) | OPS (two frames, edge-optimal) | OPS (two frames, edge& smooth optimal) | Cascaded (one frame) | Cascaded (two frames) | Cascaded (three frames) | Cascaded (four frames) | OPS (two frames, edge-optimal, per image) | OPS (two frames, edge & smooth, per image) |
|---|---|---|---|---|---|---|---|---|---|---|---|
| Agama | 2.6819 | 2.9338 | 2.9948 | 2.8110 | 2.8898 | 2.9347 | 2.9957 | 2.9998 | 3.0000 | 2.828 | 2.890 |
| Baba in Nepal | 2.3541 | 2.8304 | 2.9867 | 2.5766 | 2.6989 | 2.8309 | 2.9941 | 3.0000 | 3.0000 | 2.578 | 2.699 |
| Bamberg | 2.4238 | 2.8530 | 2.9664 | 2.6849 | 2.8079 | 2.8582 | 2.9939 | 2.9999 | 3.0000 | 2.685 | 2.808 |
| Bird | 2.5995 | 2.8977 | 2.9833 | 2.7635 | 2.8512 | 2.9076 | 2.9948 | 2.9999 | 3.0000 | 2.765 | 2.851 |
| Drift | 2.6366 | 2.9347 | 2.9952 | 2.7703 | 2.8567 | 2.9383 | 2.9979 | 3.0000 | 3.0000 | 2.788 | 2.857 |
| Farmer | 2.4702 | 2.8611 | 2.9911 | 2.6746 | 2.7938 | 2.8621 | 2.9945 | 2.9999 | 3.0000 | 2.685 | 2.794 |
| Fire | 2.7300 | 2.9278 | 2.9822 | 2.8539 | 2.9108 | 2.9455 | 2.9975 | 2.9999 | 3.0000 | 2.861 | 2.911 |
| Fly | 2.5230 | 2.8480 | 2.9653 | 2.8059 | 2.8885 | 2.8591 | 2.9909 | 2.9997 | 3.0000 | 2.808 | 2.889 |
| Gypful | 2.8332 | 2.9515 | 2.9916 | 2.9227 | 2.9729 | 2.9563 | 2.9976 | 2.9998 | 3.0000 | 2.942 | 2.973 |
| Laser | 2.3728 | 2.7674 | 2.9792 | 2.6453 | 2.7673 | 2.7936 | 2.9956 | 3.0000 | 3.0000 | 2.651 | 2.767 |
| Libelle | 2.7461 | 2.9319 | 2.9879 | 2.8552 | 2.9125 | 2.9373 | 2.9957 | 2.9998 | 3.0000 | 2.868 | 2.913 |
| Painted Ladies | 2.5505 | 2.9046 | 2.9860 | 2.7454 | 2.8435 | 2.9050 | 2.9973 | 2.9999 | 3.0000 | 2.745 | 2.844 |
| Porsche | 2.5691 | 2.8784 | 2.9672 | 2.7760 | 2.8664 | 2.8858 | 2.9959 | 2.9999 | 3.0000 | 2.779 | 2.866 |
| Suzuka | 2.6407 | 2.9244 | 2.9847 | 2.7885 | 2.8694 | 2.9339 | 2.9965 | 2.9999 | 3.0000 | 2.808 | 2.869 |
| Townhall | 2.5729 | 2.8691 | 2.9712 | 2.8250 | 2.9047 | 2.8688 | 2.9932 | 2.9998 | 3.0000 | 2.831 | 2.905 |
| Trapp | 2.8018 | 2.9700 | 2.9950 | 2.9100 | 2.9472 | 2.9753 | 2.9986 | 3.0000 | 3.0000 | 2.915 | 2.947 |
| Vespula | 2.4246 | 2.8383 | 2.9818 | 2.6663 | 2.7743 | 2.8501 | 2.9928 | 2.9999 | 3.0000 | 2.666 | 2.774 |
| Glarus Cow | 2.1670 | 2.7186 | 2.9634 | 2.4766 | 2.6263 | 2.7331 | 2.9893 | 2.9999 | 3.0000 | 2.477 | 2.626 |
| Melinaea | 2.8529 | 2.9548 | 2.9949 | 2.9171 | 2.9594 | 2.9569 | 2.9978 | 2.9999 | 3.0000 | 2.932 | 2.959 |
| Mototaxis | 2.6415 | 2.9205 | 2.9917 | 2.7765 | 2.8611 | 2.9245 | 2.9968 | 3.0000 | 3.0000 | 2.788 | 2.861 |
| **AVG** | **2.5796** | **2.8858** | **2.9830** | **2.7623** | **2.8501** | **2.8928** | **2.9953** | **2.9999** | **3.0000** | **2.771** | **2.850** |

FIG. 20

SUPERRESOLUTION DISPLAY USING CASCADED PANELS

CROSS REFERENCE

This application claims priority and benefit to U.S. Provisional Patent Application No. 61/955,057, filed on Mar. 18, 2014, titled "CASCADED DISPLAYS: SPATIOTEMPORAL SUPERRESOLUTION USING OFFSET PIXEL LAYERS," the entire content of which is incorporated by reference herein for all purposes.

TECHNICAL FIELD

The present disclosure relates generally to the field of digital image processing and display, and, more specifically, to the field of superresolution display.

BACKGROUND

The development of higher-resolution displays is of central importance to the display industry. Leading mobile displays recently transitioned from pixel densities of less than 50 pixels per cm (ppcm) and now approach 150 ppcm. Similarly, the consumer electronics industry begins to offer "4K ultra-high definition (UHD)" displays, having a horizontal resolution approaching 4,000 pixels, as the successor to high-definition television (HDTV). Furthermore, 8K UHD standards already exist for enhanced digital cinema. Achieving such high-resolution displays currently hinges on advances that enable spatial light modulators with increased pixel counts.

Beyond these larger market trends, several emerging display technologies necessitate even greater resolutions than 4K/8K UHD standards will provide. For example, wide-field-of-view head-mounted displays (HMDs), such as the Oculus Rift, incorporate high-pixel-density mobile displays. Such displays approach or exceed the resolution of the human eye when viewed at the distance of a phone or tablet computer. However, they appear pixelated when viewed through magnifying HMD optics, which dramatically expand the field of view. Similarly, glasses-free 3D displays, including parallax barrier and integral imaging, require an order of magnitude higher resolution than today's displays. At present, HMDs and glasses-free 3D displays remain niche technologies and are less likely to drive the development of higher-resolution displays than the existing applications, hindering their advancement and commercial adoption.

The following briefly reviews the state-of-art related to high resolution display technologies.

Superresolution imaging algorithms have been used to recover a high-resolution image (or video) from low-resolution images (or videos) with varying perspectives. Superresolution imaging requires solving an ill-posed inverse problem: the high-resolution source is unknown. Methods differ based on the prior assumptions made regarding the imaging process. For example, in one approach, camera motion uncertainty is eliminated by using piezoelectric actuators to control sensor displacement.

In one of the superresolution display systems that have been developed, a "wobulation" method is used to double the addressed resolution for front-projection displays incorporating a single high-speed digital micro-mirror device (DMD). A piezoelectrically-actuated mirror displaces the projected image by half a pixel, both horizontally and vertically. Since DMDs can be addressed faster than the critical flicker fusion threshold, two shifted images can be rapidly projected, so that the viewer perceives their additive superposition. As with a jittered camera, the superresolution factor increases as the pixel aperture ratio decreases. The performance is further limited by motion blur introduced during the optical scanning process. More recently, wobulation has been extended to flat panel displays, using an eccentric rotating mass (ERM) vibration motor applied to an LCD.

Similar superresolution display concepts have been developed for digital projectors. Rather than presenting a time-multiplexed sequence of shifted, low-resolution images, projector arrays can be used to display the displaced image set simultaneously. Such "superimposed projection" systems have been demonstrated by multiple research groups. As with all projected arrays, superimposed projections required precise radiometric and geometric calibration, as well as temporal synchronization. These issues can be mitigated using a single-projector superresolution method where multiple offset images are created by an array of lenses within the projector optics. Unlike superimposed projectors, these images must be identical, resulting in limited image quality.

Wobulation and other temporally-multiplexed methods introduce artifacts when used to superresolve videos due to unknown gaze motion. Eye movement alters the desired alignment between subsequent frames, as projected on the retina. If the gaze can be estimated, then superresolution can be achieved along the eye motion trajectory, as reportedly demonstrated.

All of the superresolution displays discussed thus far implement the same core concept: additive (temporal) superposition of shifted low-resolution images. As with image superresolution, such designs benefit from low pixel aperture ratios-diverging from industry trends to increase aperture ratios.

The so-called "optical pixel sharing (OPS)" approach is the first reported approach to exploit dual modulation projectors for superresolution by depicting an edge-enhanced image using a two-frame decomposition: the first frame presents a high-resolution, sparse edge image, whereas the second frame presents a low-resolution non-edge image. OPS requires an element be placed between the display layers (e.g., an array of lenses or a randomized refractive surface); correspondingly, existing OPS implementations do not allow thin form factors. OPS reproduces imagery with decreased brightness and decreased peak signal-to-noise ratio (PSNR).

Dual-modulation displays are routinely applied to achieve high dynamic range (HDR) display. HDR projectors are implemented by modulating the output of a digital projector using large flat panel liquid crystal displays (LCDs). A high dynamic range and high resolution projector system has been reportedly developed, where a three-chip liquid crystal on silicon (LCoS) projector emits a low-resolution chrominance image, which is subsequently projected onto another higher-resolution LCoS chip to achieve luminance modulation.

Displays with two or more Spatial Light Modulators (SLMs) have also been incorporated in glasses-free3D displays for multi-view imagery. It was reportedly demonstrate that content-adaptive parallax barriers can be used with dual-layer LCDs to create brighter, higher-resolution 3D displays.

SUMMARY OF THE INVENTION

Therefore, it would be advantageous to provide a display mechanism offering a high spatial and/or temporal display resolution beyond the native resolution and/or frame refresh rate of current-generation display panels.

Provided herein are methods and systems for image and video displays with increased spatial resolution using current-generation light-attenuating spatial light modulators (SLM), including liquid crystal displays (LCDs), digital micro-mirror devices (DMDs), and liquid crystal on silicon (LCoS) displays. Without increasing the addressable pixel count, cascaded displays in conjunction with pertinent data processing processes are employed to serve this end.

More specifically, in some embodiments, two or more SLMs are disposed on top of one another (or in a cascaded manner), subject to a lateral offset of half a pixel or less along each axis. The lateral offsets makes each pixel on one layer modulates multiple pixels on another. In this manner, the intensity of each subpixel fragment—defined by the geometric intersection of a pixel on one display layer with one on another layer—can be controlled, thereby increasing the effective display resolution. High resolution target images are factorized into multi-layer attenuation patterns, demonstrating that cascaded displays may operate as "compressive displays:" utilizing fewer independently-addressable pixels than apparent in the displayed image.

The similar methods may be adopted to increase the temporal resolution of stacks of two or more SLMs, refreshed in staggered intervals. However, in some other embodiments, temporal multiplexing of factorized imagery may not involved. As a result, videos can be presented without the appearance of artifacts characteristic of prior methods or the requirement for high-refresh-rate displays.

In contrast with the additive approaches adopted in the prior art, cascaded displays according to the present disclosure create a multiplicative superposition by synthesizing higher spatial frequencies by the (simultaneous) interference of shifted light-attenuating displays with large aperture ratios.

Cascaded displays offer several distinct advantages relative to prior superresolution displays: achieving thin form factors, requiring no moving parts, and using computationally-efficient factorization processes to enable interactive content.

According to one embodiment of the present disclosure, a method of displaying images comprises: (1) accessing original image data representing an image; factorizing the original image data into first image data and second image data; and displaying a representation of the image on a display device at an effective display resolution. The display device comprises a first display layer having a first native resolution and a second display layer having a second native resolution. The first display layer overlays the second display layer. The first image data is rendered for display on the first display layer, and the second image data is rendered for display on the second display layer. The effective display resolution is greater than the first and second native resolutions.

In one embodiment, the display devices include L display layers, where a respective display layer is laterally offset relative to an immediately adjacent display layer by 1/L pixel in two orthogonal directions. A pixel in the respective display layer is modulated using multiple pixels of an underlying display layer in the L display layers. The first and second image data may each correspond to a respective single frame of the image.

The original image data may represent a single frame of pixels of the image, wherein the first image data represents a first plurality of frames the image, and the second image data represent a second plurality of frames of the image. The first plurality of frames are sequentially rendered on the first display layer, and the second plurality of frames are sequentially rendered on the second display layer. The first plurality of frames and the second plurality of frames can be rendered in synchronization or out of synchronization.

According to another embodiment of the present disclosure, a method of displaying images comprises: (1) accessing first frames representing one frame of an image in a first spatial resolution; (2) accessing second frames representing the one frame of the image in a second spatial resolution; (3) sequentially rendering the first frames for display on a first display layer of a display device; and (4) sequentially rendering the second frames for display on a second display layer of the display device. The first display layer overlays the second display layer with a lateral shift in two perpendicular directions by a fraction of a pixel of the first display layer. An effective display resolution resulted from the sequentially renderings is greater than the first spatial resolution and the second spatial resolution.

According to another embodiment of the present disclosure, a display system comprises: a processor; memory; and a plurality of display layers coupled to the processor and the memory and disposed in a cascaded manner and comprising a first and a second display layers. The first display layer offsets by a fraction of a pixel with reference to the second display layer in two orthogonal lateral directions. The memory stores instructions that implement a method comprising: (1) accessing first image data representing the image and second image data representing the image; (2) rendering the first image data for display on the first display layer at a first spatial resolution; and (3) rendering the second image data for display on the second display layer at a second spatial resolution. An effective display resolution of the representation of the image is greater than the first native spatial resolution and the second native spatial resolution.

The foregoing is a summary and thus contains, by necessity, simplifications, generalization and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which:

FIG. 11 are data plots comparing performances of the exemplary WNMF methods with double precision factorization used for superresolution in a cascaded display in accordance with an embodiment of the present disclosure;

FIG. 15 illustrates an exemplary method of creating subpixel fragments by dual-layer cascaded displays with cyan-yellow-magenta color filter arrays (CFAs);

FIG. 19 is a chart comparing Peak signal-to-noise (PSNR) in [dB] for a set of natural images obtained in various superresolution techniques according to the prior art and cascaded displays according to the present disclosure;

FIG. 20 is a chart showing structural similarity index (SSIM) as a sum over all color channels for a set of natural images obtained in various superresolution techniques according to the prior art and cascaded displays according to the present disclosure;

DETAILED DESCRIPTION

Figure 1A:
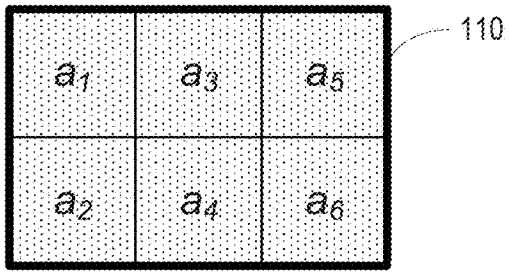
FIG. 1A-1C illustrates the relative lateral positions between two display layers and in an exemplary cascaded display device in accordance with an embodiment of the present disclosure.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. Although a method may be depicted as a sequence of numbered steps for clarity, the numbering does not necessarily dictate the order of the steps. It should be understood that some of the steps may be skipped, performed in parallel, or performed without the requirement of maintaining a strict order of sequence. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

Notation and Nomenclature

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or display devices. When a component appears in several embodiments, the use of the same reference numeral signifies that the component is the same component as illustrated in the original embodiment.

Superresolution Display Using Cascaded Panels

As used herein, the term "superresolution" (SR) refers to signal-processing techniques designed to enhance the effective spatial resolution of an image or an imaging system to better than that corresponding to the size of the pixel of the original image or image sensor.

Overall, embodiments of the present disclosure create a multiplicative superposition by synthesizing higher spatial and/or temporal frequencies by the simultaneous interference of shifted light-attenuating displays with large aperture ratios. A stack of two or more multiplicative display layers (or spatial light modulator (SLM) layers) are integrated in a display device to synthesize a spatially-superresolved image. Based on an original image or a set of video frames with a target spatial/temporal resolution, a factorization process is performed to derive respective image data for presentation on each display layer.

In one aspect, the display layers in a stack are laterally shifted with each other, resulting in an effective spatial resolution exceeding the native display resolutions of the display layers. High fidelity to a high resolution original image can be advantageously achieved with or without time-multiplexing attenuation patterns, although the later offer better performance in terms of reducing the appearance of artifacts. A real-time, graphics processing unit (GPU)-accelerated cascaded display algorithm is presented and eliminates the need for temporal multiplexing, while preserving superresolution image fidelity.

In another aspect, two or more display layers (or SLMs) are refreshed in staggered intervals to synthesize a video with an effective refresh rate exceeding that of each individual display layer, e.g., by a factor equal to the number of layers. Further optically averaging neighboring pixels can minimize artifacts.

Also provided herein is a comprehensive optimization framework based on non-negative matrix and tensor factorization. Particularly, the weighted rank-1 residue iteration approach can outperform the prior multiplicative update rules.

Modeling Cascaded Dual-Layer Displays

In general, the construction of the cascaded display device may exploit spatial or temporal multiplexing to increase the effective number of addressable pixels. As a result, a decomposition problem needs to be solved to determine the optimal control of the display components to maximize the perceived resolution, subject to physical constraints (e.g., limited dynamic range, restricted color gamut, and prohibition of negative emittances).

In one embodiment, a dual-layer display includes a pair of spatial light modulators (SLMs) placed in direct contact in front of a uniform backlight and contains a uniform array of pixels with individually-addressable transmissivity at a fixed refresh rate. The layers are disposed with a lateral offset of each other. For example, the layers can be offset from each other by a fraction of a pixel in two orthogonal directions. However, the present disclosure is not limited by the amount, dimension, or directions of the lateral offset.

Figure 1B:
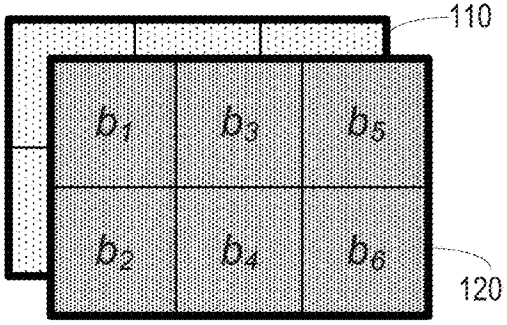
Figure 1C:
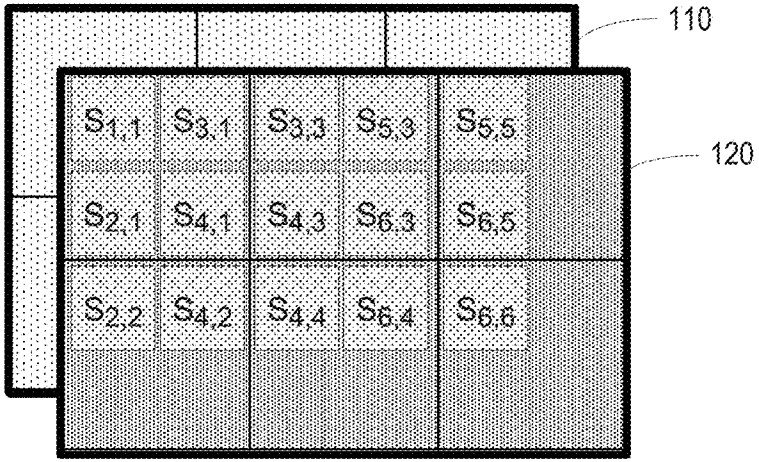

FIG. 1A-1C illustrates the relative lateral positions between two display layers 110 and 120 in an exemplary cascaded display device in accordance with an embodiment of the present disclosure. FIG. 1A shows sample pixels of the bottom layer 110, $a_1$-$a_6$; FIG. 1B shows sample pixels of the top layer 120 overlaying the bottom layer 110, $b_1$-$b_6$; and FIG. 1C shows the subpixel fragments ($S_{2,1}$-$S_{6,6}$) resulted from cascaded and shifted arrangement of the two layers. The pixels on the top layer 110 are each laterally shifted by half a pixel relative to the bottom layer 120, both horizontally and vertically. Thus, the pixel centers of the top layer 110 coincide with the pixel corners of the bottom layer 120.

As a result, this configuration creates a uniform array of subpixel fragments defined by the overlap of pixels on the bottom layer with those on the top. For example, the subpixel fragment $S_{2,1}$ is defined by the pixel $a_2$ of the bottom layer 110 and pixel $b_1$ of the top layer. Therefore, there exist four times as many subpixel fragments as pixels on an individual, establishing the capacity to quadruple the spatial resolution.

Assuming the bottom layer 110 has N pixels and the top layer 110 has M pixels in total. During operation of the display device, K time-multiplexed frames are presented to the viewer at a rate above the critical flicker fusion threshold, such that their temporal average is perceived. Using temporal multiplexing can advantageously increase the degrees of freedom available to reduce image artifacts.

Hereinunder, the emissivity of pixel i in the bottom layer 110, for frame k, is denoted as $a_i^{(k)}$, such that $0 \le a_i^{(k)} \le 1$. Similarly, $b_j^{(k)}$, denotes the transmissivity of the pixel j of the top layer, for frame k, such that $0 \le b^{(k)} \le 1$. The emissivity of each subpixel fragment is represented by $s_{i,j}$, which can be expressed as $$s_{i,j} = w_{i,j}\left(\sum_{k=1}^{K} a_i^{(k)} b_j^{(k)}\right), \tag{1}$$

where $w_{i,j}$ is a factor for denoting the overlap of pixel i and pixel j.

This expression (1) implies that dual-layer image formation can be concisely expressed using matrix multiplication:

$$S = W \circ (AB^T). \tag{2}$$

where $\circ$ denotes the Hadamard (element-wise) matrix product; A is an N×K matrix, whose columns contain bottom layer pixel emissivities during frame k; B is an M×K matrix, whose columns contain the top-layer pixel transmissivities during frame k; W is an N×M sparse weight matrix, containing the pair-wise overlaps; and S is a sparse N×M matrix containing the subpixel fragment emissivities. S can be non-zero only where pixel i and pixel j overlap.

The image formation model given by Equations (1) and (2) can be applied to various types of spatial light modulators, including panels with differing pixel pitches. Furthermore, relative lateral translations and in-plane rotations of the two layers can be encoded in an appropriate choice of the weight matrix W.

This model can be practically applied to existing flat panel displays (e.g., LCD panels containing color filter arrays and limited pixel aperture ratios) and digital projectors (e.g., those containing LCD, LCoS, or DMD spatial light modulators), and so on.

Spatial Superresolution

Cascaded displays according to the present disclosure can provide enhanced spatial resolution by layering spatially-offset, temporally-averaged display panels.

Figure 2:
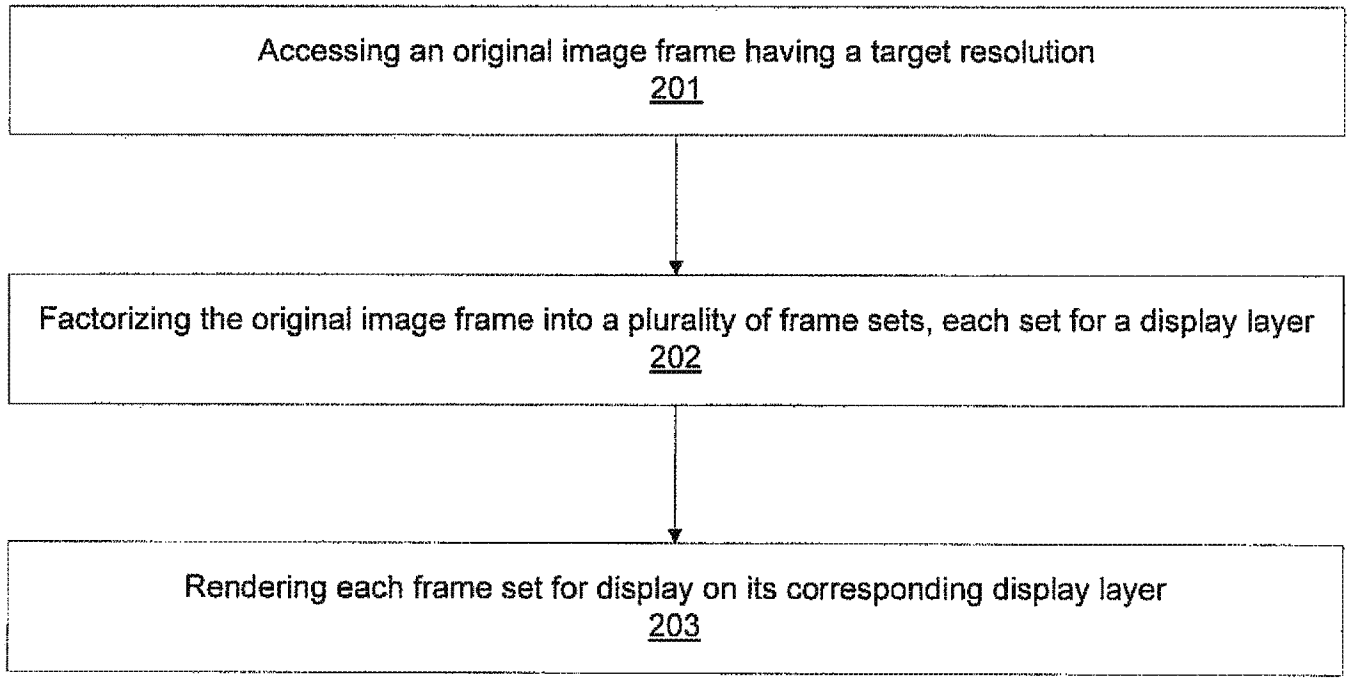
FIG. 2 is a flow chart depicting an exemplary process of display an image on a cascaded display device with a superresolution in accordance with an embodiment of the present disclosure.

FIG. 2 is a flow chart depicting an exemplary process 200 of display an image on a cascaded display device with a superresolution in accordance with an embodiment of the present disclosure. Assuming the display device includes L display layers, where L is an integer value greater than 2. At 201, an original image frame having an original spatial resolution (or the target resolution) is accessed. The original image frame may be a static image or one frame of a video. The original spatial resolution may be greater than the native spatial resolution of any of the L display layers in the display device.

In some embodiments, assuming all layers have identical square pixels, each layer is offset by 1/L pixel with respect to the previous layer. The resultant cascaded display then has $L^2$ times as many subpixel fragments as any individual layer therein.

At 202, the original image frame is decomposed into multiple frame sets through a factorization process, each frame set for a respective display layer. The factorization process can be performed in various suitable manners, including the exemplary computational processes described in greater detail below. Each respective frame set may contain one or more frames (also referred to as "patterns" herein) in a spatial resolution compatible with the corresponding display layer.

At 203, the frame sets derived from 202 are rendered on respective display layers for display. More specifically, with regards to each display layer, the corresponding frame set is rendered sequentially for display. As a collective result, a user can perceive an effective spatial resolution of the display device that exceeds the native resolution of each individual layer. A spatial superresolution is therefore advantageously achieved.

To factorize a target high-resolution image, in some embodiments, the image can be sampled and rearranged as a sparse matrix $W \circ T$ containing subpixel fragment values analogously to S. Thus, the image is represented by a series of time-multiplexed attenuation pattern pairs (e.g., columns of A and B to be displayed across the two layers).

For example, to display or reconstruct an image on a cascaded dual-layer display in a superresolution, the original image data can be factorized into two single patterns, one for each layer. In some other embodiments, temporal multiplexing can be incorporated in the factorization process to derive multiple frames for display during the integration period of the user eyes. Thus, the multiple frames in each frame set are consecutively rendered for display on a corresponding layer.

Figure 3:
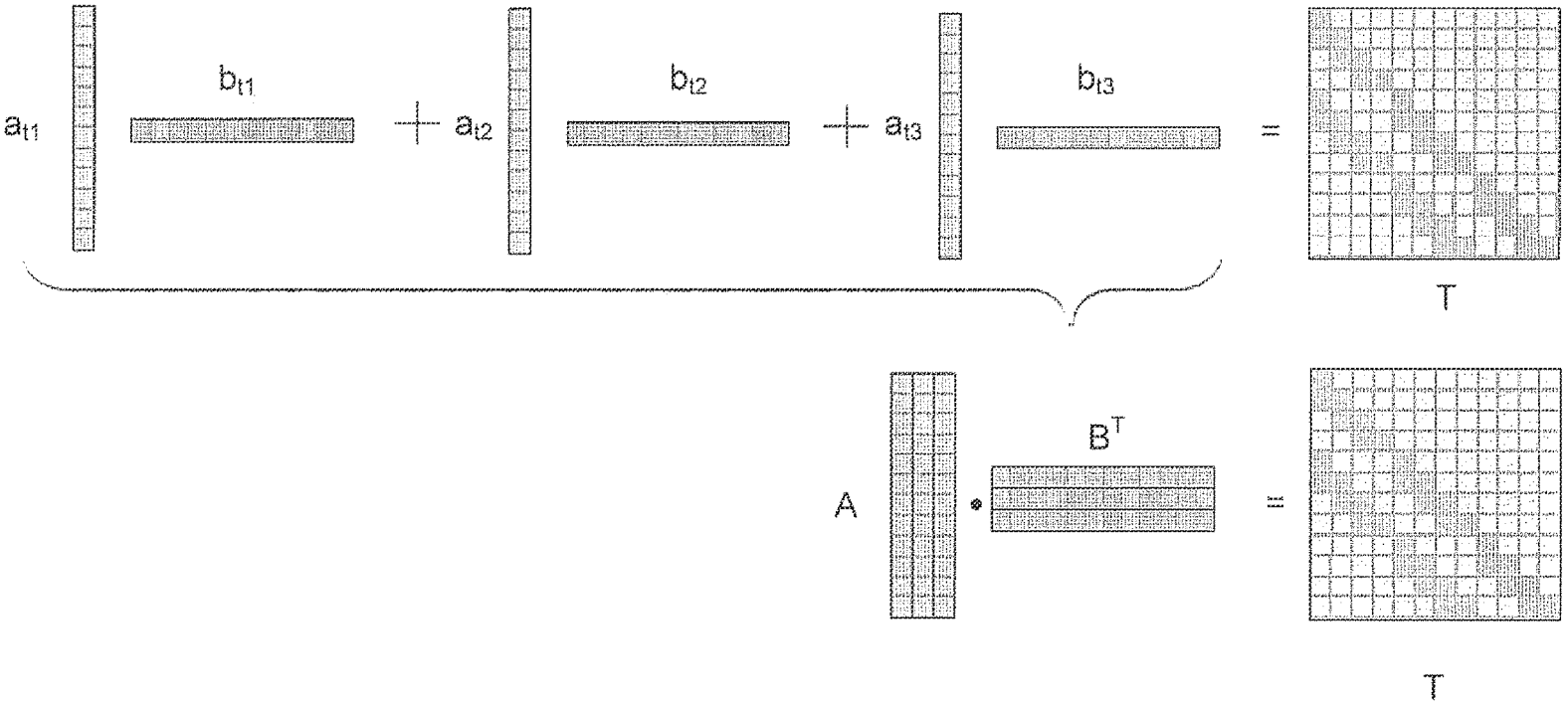
FIG. 3 illustrates an exemplary factorization process with time-multiplexing for cascaded display in accordance with an embodiment of the present disclosure.

FIG. 3 illustrates an exemplary factorization process with time-multiplexing for cascaded display in accordance with an embodiment of the present disclosure. It shows that each frame data for a particular layer is represented by a vector. More specifically, $a_{t1}$, $a_{t2}$, and $a_{t3}$ represent the frames to be display on the first layer (Layer A) at frame refresh times $t_1$, $t_2$, and $t_3$, respectively; and $b_{t1}$, $b_{t2}$, and $b_{t3}$ represent the frames to be display on the first layer (Layer B) at frame refresh times $t_1$, $t_2$, and $t_3$, respectively. Expressed in a compact form, the time-multiplexed frames for each layer are represented by a matrix (A or B). The matrix T represents the original image frame in a high resolution. The goal of the factorization process is to find appropriate A and B to make their product equal to or approximate to the priori which is the target image T.

Figure 4:
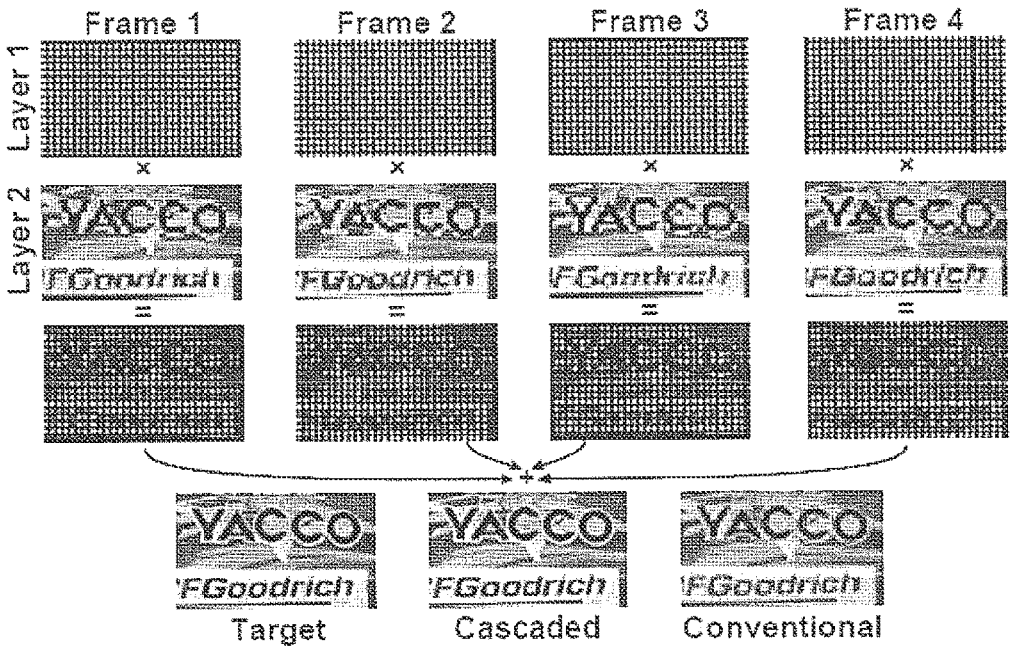
FIG. 4 illustrates the image frames derived in an exemplary heuristic factorization process configured for spatial superresolution in accordance with an embodiment of the present disclosure.

In one embodiment, a simple heuristic factorization is utilized and capable of losslessly reconstructing a spatially-superresolved target image using four time-multiplexed attenuation layer pairs (K=4), assuming that both layers have the same pixel structure and the lateral shift is half a pixel along both axes. FIG. 4 illustrates the image frames derived in an exemplary heuristic factorization process configured for spatial superresolution in accordance with an embodiment of the present disclosure.

As shown, a time-multiplexed sequence of shifted pinhole grids are displayed on the bottom layer (first row representing frames for Layer 1), together with aliased patterns on the top layer (second row representing frames for Layer 2). Each bottom-layer pixel illuminates the corners of four top-layer pixels, as shown in row 3. When the four frames are presented at a rate exceeding the flicker fusion threshold, the viewer perceives an image with four times the number of pixels in any layer. Note that, the cascaded display may appear dimmer than a conventional display if the backlight brightness remains the same.

As shown in FIG. 4, during the first frame, the bottom layer (Layer 1) depicts a pinhole grid, where only the first pixel in each 2×2 pixel block is illuminated. Each top-layer (Layer 2) pixel is assigned the transmittance of the corresponding target subpixel fragment. Only one quarter of the target subpixel fragments will be reconstructed when a given pinhole grid is displayed on the bottom layer. As a result, four time-multiplexed layer pairs are required, comprising four shifted pinhole grids.

Although no artifacts are present in the reconstructed images, heuristic factorizations appear with one quarter the brightness as a conventional single-layer display, since each subpixel fragment is only visible during one of four frames.

In another embodiment, an optimized compressive factorization process is employed for deriving the frame data for respective layers. By application of Equation (2), optimal dual-layer factorizations are provided by solving the following constrained least-squares problem:

$$\underset{\{0\le A\le 1,\,0\le B\le 1\}}{\arg\min}\ \frac{1}{2}\|W\circ(\beta T - AB^T)\|_2^2, \tag{3}$$

where $\le$ is the element-wise matrix inequality operator. Note that for the brightness scaling factor, $0<\beta\le 1$ is required to allow solutions that reduce the luminance of the perceived image, relative to the target image (e.g., as observed with the heuristic four-frame factorization). If the upper bounds on A and B are ignored, then Equation (3) corresponds to weighted non-negative matrix factorization (WNMF). As a result, any weighted NMF algorithm can be applied to achieve spatial superresolution, with the pixel values clamped to the feasible range after each iteration. For example, the following multiplicative update rules can be used:

$$A \leftarrow A \circ \frac{(W\circ(\beta T))B}{(W\circ(AB^T))B} \quad B \leftarrow B \circ \frac{A^T(W\circ(\beta T))}{A^T(W\circ(AB^T))} \tag{4}$$

The double line operator denotes Hadamard (element-wise) matrix division.

Similar multiplicative update rules can be applied to multi-layer 3D displays. In terms of computation performance, weighted rank-1 residue iterations (WRRI) may be preferred for being robust and efficient. Table 1 presents a pseudo code showing an exemplary factorization process of deriving the matrix A and B which represent the frame data sets for two display layers, respectively. A and B are calculated iteratively according to a weighted Rank-I Residue (WRRI) iteration process. WRRI is specified in Table 1, with $x_j$ denoting column j of a matrix X and $[x_j]_+$ denoting projection onto the positive orthant, such that element i of $[x_j]_+$ is given by max(0, $x_{i,j}$).

TABLE 1

Algorithm 1 Weighted Rank-1 Residue Iterations (WRRI)

Figure 5:
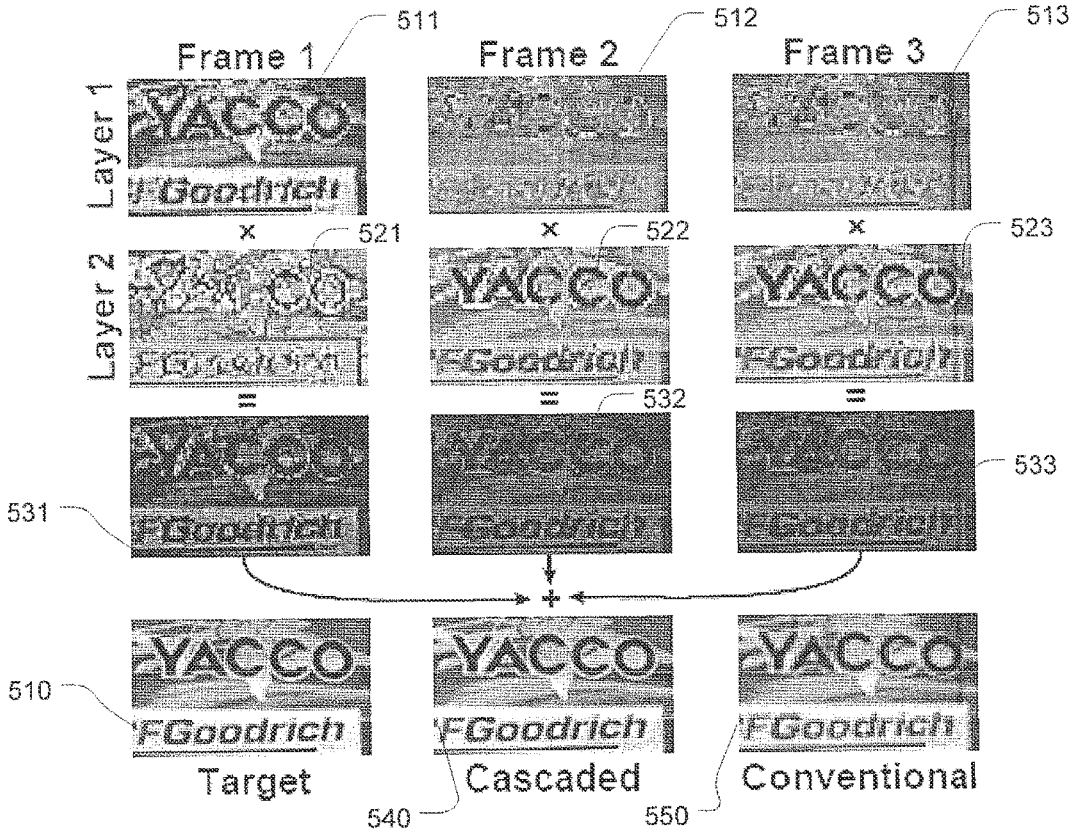
FIG. 5 shows the image frames resulted from spatial optimized factorization for spatial superresolution according to the WRRI process presented in Table 1 in accordance with an embodiment of the present disclosure.

1: Initialize A and B
2: repeat
3: for k = 1 to K do
4: $R_k = T - \Sigma_{i \neq k} a_i b_i^T$ ▷ Evaluate rank-1 residue.
5: $a_k \leftarrow \left[ \frac{[(W \circ R_k) b_k]_+}{W(b_k \circ b_k)} \right]_+$ ▷ Update column k of A.
6: $b_k \leftarrow \left[ \frac{[(W \circ R_k)^T a_k]_+}{W^T(a_k \circ a_k)} \right]_+$ ▷ Update column k of B.
7: end for
8: until Stopping condition FIG. 5 shows the image frames resulted from spatial optimized factorization for spatial superresolution according to the WRRI process presented in Table 1 in accordance with an embodiment of the present disclosure. The Algorithm 1 presented in Table 1 provides the optimal three-frame dual-layer factorization of the target image 510. For instance, the layers are initialized with uniformly-distributed random values for all frames. In comparison with the heuristic factorization, both layers contain content-dependent features.

As described above, Equations (2) and (3) cast image formation by dual-layer cascaded displays as a matrix factorization problem, such that the factorization rank equals the number of time-multiplexed frames. Hence, WNMF-based factorization allows configurations of reconstruction accuracy, the number of time-multiplexed frames, and the brightness of the reconstructed image.

The partial reconstructions are presented in frames of 531, 532, and 533 and the cascaded image 540 is presented as the end result, which is compared with a reconstructed image 550 using a conventional approach and the target image 510. When the three frames for an individual layer (e.g., 511-513 of Layer 1) are presented at a rate greater than the critical flicker fusion threshold, the viewer perceives a superresolved image 540 with four times the number of pixels. If backlight brightness remains the same, the cascaded display may appear dimmer than a conventional display using a single display layer. Increasing the brightness scaling factor β can compensate for absorption losses.

As discussed with reference to FIGS. 6A and 6B, in image presentation on a cascaded display, the time-multiplexed frames can be rendered on the multiple layers either in synchronization or out of synchronization, e.g., in a staggered manner. It will be appreciate that, with respect to a particular target image, the frame sets derived for synchronized frame refreshment differ from those derived for the unsynchronized refreshment.

Figure 6A:
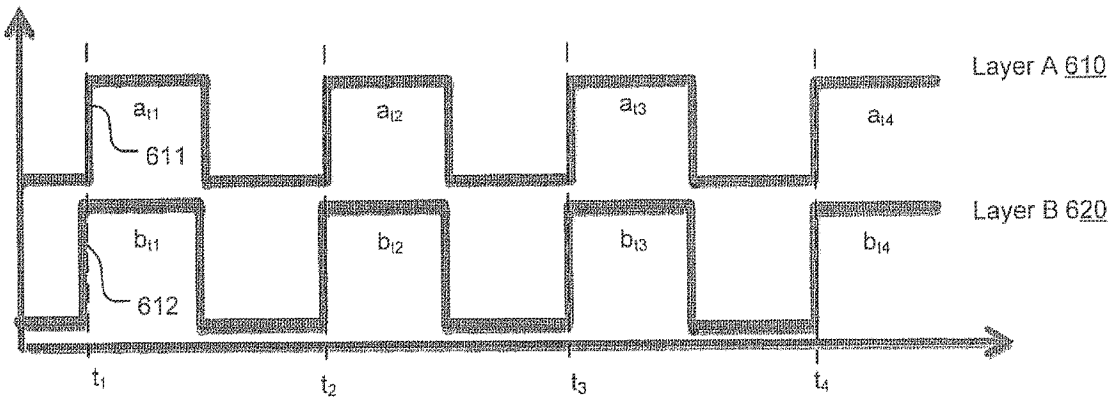
FIG. 6A are time diagrams illustrating synchronized frame refresh cycles and for two display layers included in an exemplary cascaded display device configured to achieve spatial superresolution in accordance with an embodiment of the present disclosure.

FIG. 6A are time diagrams illustrating synchronized frame refresh cycles 610 and 620 for two display layers included in an exemplary cascaded display device configured to achieve spatial superresolution in accordance with an embodiment of the present disclosure. For instance, the original image data have been factorized into two frame sets for Layer A and Layer B, respectively, and each frame set includes four time-multiplexed frames. In this example, the frame refresh times coincides with the rising edges of the refresh cycles (shown as $t_1$, $t_2$, $t_3$ and $t_4$) on the time diagrams 610 and 620, FIG. 6A shows that layer A frames ($a_{t1}$, $a_{t2}$, $a_{t3}$ and $a_{t4}$) are refreshed in synchronization with layer B ($b_{t1}$, $b_{t2}$, $b_{t3}$ and $b_{t4}$). For example, at time $t_1$, frame $a_{t1}$ and frame $b_{t1}$ are contemporaneously rendered on layer A and layer B, respectively.

Figure 6B:
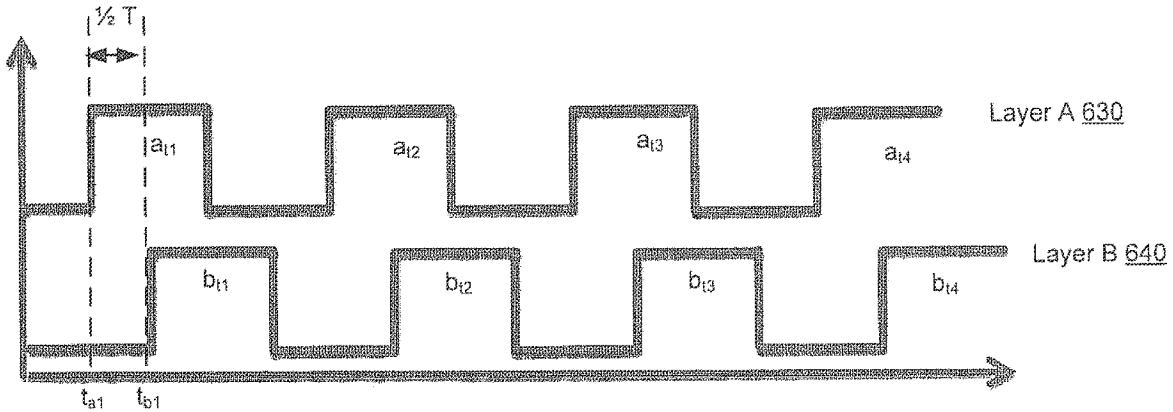
FIG. 6B are time diagrams illustrating unsynchronized frame refresh cycles and for two display layers included in an exemplary cascaded display device configured to achieve spatial superresolution in accordance with an embodiment of the present disclosure FIG. 7 are time diagrams illustrating frame refresh cycles and for two display layers of an exemplary cascaded display device configured to achieve temporal superresolution in accordance with an embodiment of the present disclosure.

FIG. 6B are time diagrams illustrating unsynchronized frame refresh cycles 630 and 640 for two display layers included in an exemplary cascaded display device configured to achieve spatial superresolution in accordance with an embodiment of the present disclosure. For instance, the original image data have been factorized into two frame sets for Layer A and Layer B, respectively. Each frame set includes four time-multiplexed frames. In this example, each layer has the same frame refresh periods, and the frame refresh times coincides with the rising edges of the refresh cycles on the time diagrams 630 and 640. FIG. 6B shows that layer A frames ($a_{t1}$, $a_{t2}$, $a_{t3}$ and $a_{t4}$) are refreshed in a time offset from layer B frames ($b_{t1}$, $b_{t2}$, $b_{t3}$ and $b_{t4}$). For example, frame $a_{t1}$ is rendered on layer A at time $t_{a1}$, while frame $b_{t1}$ is rendered on layer B at time $t_{b1}$. In this example, $t_{b1}$ lags behind $t_{a1}$ by half a cycle.

In some embodiments, given a cascaded display with L (L>1) layers that are refreshed in a staggered manner, a frame refresh time of a particular layer may lag behind the frame refresh time of a previous layer by a fraction (=1/L for example) of frame refresh cycle.

In general, cascaded displays advantageously can achieve high quality results in terms of spatial and temporal resolutions, even without temporal multiplexing. As discussed above, eliminating temporal multiplexing is equivalent to displaying a rank-1 factorization. WRRI is a preferred efficient method for solving this rank-1 factorization, achieving real-time frame rates for high-definition (HD) target frames (a variant of alternating least squares for solving NMF as discussed in detail below). This observation is significant to enable real-time applications. For instance, a GPU-based implementation of fast rank-1 factorization can be used for interactive operation of the cascaded head-mounted display).

Spatialtemporal Superresolution

Cascaded displays according to the present disclosure can also enhance temporal resolution by layering multiple temporally-offset, spatially-averaged displays. Temporally offsetting multiple display panels of a cascaded display synthesizes a temporal superresolution display. More specifically, the frame refresh time for each layer is offset from that of a previous layer by a fraction of a fraction of frame refresh cycle. As a consequence, a viewer of the cascaded display perceives a video content being displayed in a high refresh rate than the native refresh rate(s) of individual layers.

Figure 7:
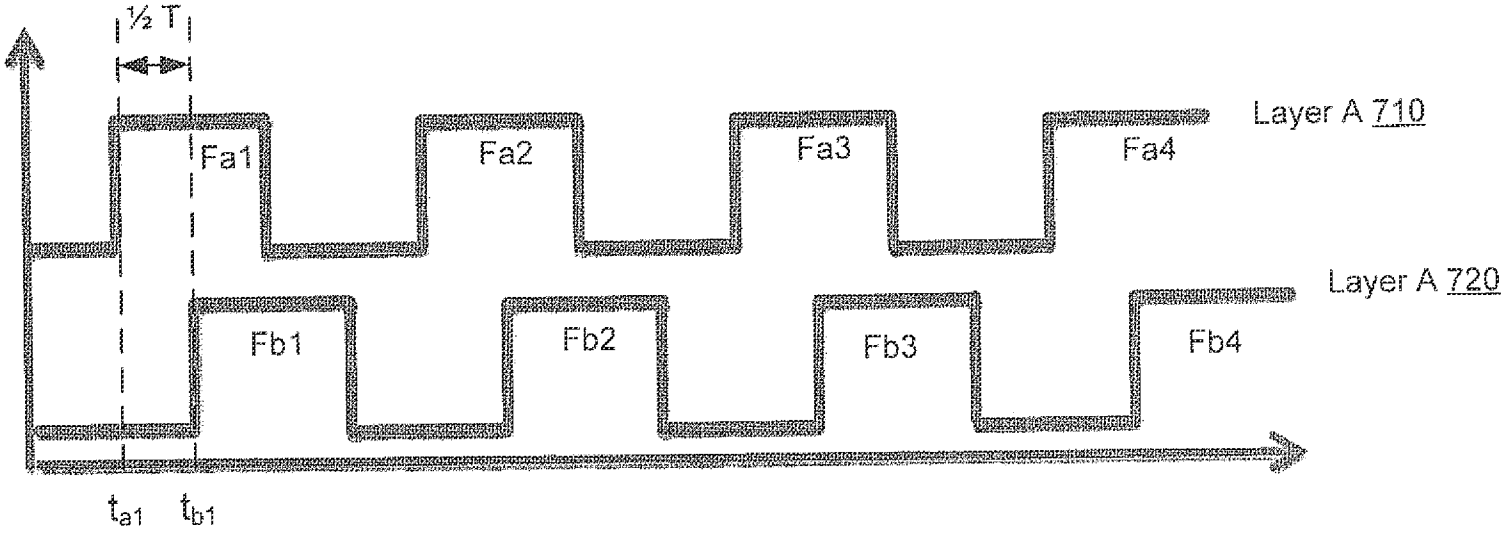

In some embodiments, the multiple layers in the cascaded display are mechanically aligned with respect to pixels and are refreshed in a staggered fashion. FIG. 7 are time diagrams illustrating frame refresh cycles 710 and 720 for two display layers of an exemplary cascaded display device configured to achieve temporal superresolution in accordance with an embodiment of the present disclosure. In this example, a video including four frames ($F_1$-$F_4$) is factorized into two frame sets for two layers respectively, with frames $F_{a1}$-$F_{a4}$ for layer A, and frames $F_{b1}$-$F_{b4}$ to layer B. Each framed set are rendered on the display layer in a native refresh rate, e.g., 50 Hz. The frame refresh times of the two layers are staggered by half a frame refresh cycle. For example, frame $F_{a1}$ is rendered on layer A (at $t_{a1}$) half cycle ahead of $F_{b1}$ being presented on layer B (at $t_{b1}$). As a result, a 100 Hz display is synthesized.

According to the present disclosure, for spatial superresolution, optional temporal multiplexing generally enhances the reconstruction fidelity. Similarly, for temporal superresolution, spatial averaging reduces reconstruction artifacts by increasing the degrees of freedom afforded by dual-layer displays with staggered refreshes. In some embodiments, spatial averaging is achieved by introducing a diffusing optical element on top of a flat panel cascaded display (e.g., a dual-layer LCD) or by defocusing a projector employing cascaded displays.

Equation (5) is an exemplary objective function to determine optimal factorizations for temporal superresolution:

$$\underset{\{0\le A\le 1, 0\le B\le 1\}}{\arg\min} \frac{1}{2}\|W\circ(\beta T - CP_1AB^TP_2)\|_2^2, \tag{5}$$

Here, A is a length-FN column vector, containing the bottom-layer pixel emissivities, concatenated over F video frames; similarly, B is a length-FM column vector, containing the top-layer pixel transmissivities, concatenated over F video frames. The permutation matrices $\{P_1, P_2\}$ reorder the reconstructed subpixel fragments $S=AB^T$ such that the first F columns of the product $P_1AB^TP_2$ contain the length-NM subpixel fragments, corresponding to the superresolved image displayed during the corresponding frame. Spatial averaging is represented as the FN×FN convolution matrix C, which low-pass filters the columns of $P_1AB^TP_2$.

Once again, W is a sparse weight matrix, containing the pair-wise overlaps across space and time. Finally, $W\circ T$ denotes the subpixel fragments for the target temporally-superresolved video. In some embodiments, if the goal is to increase frame rate, not spatial fidelity, time-multiplex needs not be performed on each target frame over K factorization frames.

Joint spatial and temporal superresolution is directly supported by the objective function presented in Equation (5). The weight matrix W subsumes temporal as well as spatial overlaps. Hence, it is sufficient to set the weight matrix elements accordingly. To solve Equation (5), in some embodiments, the following update rules (6) and (7) are used for implementing temporal superresolution using cascaded dual-layer displays, as described in greater detail in a later section below.

$$A \leftarrow A \circ \frac{P_1^TC^T(W\circ(\beta T))P_2^TB}{P_1^TC^T(W\circ(CP_1AB^TP_2))P_2^TB} \tag{6}$$

$$B \leftarrow B \circ \frac{A^TP_1^TC^T(W\circ(\beta T))P_2^T}{A^TP_1^TC^T(W\circ(CP_1AB^TP_2))P_2^T} \tag{7}$$

For simplicity, these multiplicative update rules are specified for spatiotemporal superresolution. However, the WRRI algorithm can be similarly adapted. More specifically, given an implementation for the update rules of Equation (4), instead of constructing the matrices {C, P1, P2}, a spatial blur is applied to the current estimate $AB^T$ between the iterations.

Figure 8:
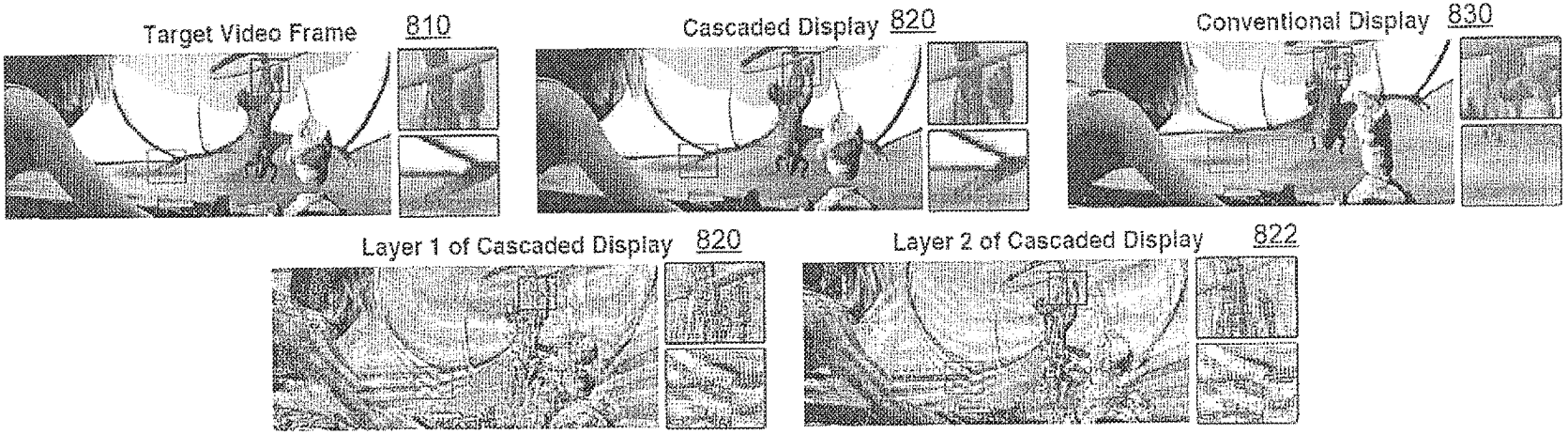
FIG. 8 shows temporal superresolution results using a cascaded dual-layer display according to an embodiment of the present disclosure.

FIG. 8 shows temporal superresolution results 820 using a cascaded dual-layer display according to an embodiment of the present disclosure. In this example, the display layers refresh in a staggered fashion and are assumed to be mechanically aligned. Diagram 810 shows a single frame from the target video (which has twice the refresh rate as the display layers). Diagram 820 is achieved by using Equations (6) and (7) to factorize the target video and rendering the factorized frames 821 and 822 on each layer for display at half the rate of the target video. The reconstruction of the target frame shows minimal artifacts, after blurring by a uniform 2×2-pixel spatial blur kernel. Diagram 830 shows a conventional display refreshed at half the rate of the target video. During this frame, the conventional display lags behind the target video and cascaded display for the depicted frame. As shown in diagrams 821 and 822, high-frequency details are spatially averaged before being perceived by the viewer e.g., by a diffuser or by defocusing projection optics.

In one embodiment, all layers and frames are initialized to uniformly-distributed random values. The entire video is factorized simultaneously. For longer videos, a sliding window of frames can be factorized, constraining the first frames in each window to equal the last frames in the previous window. As demonstrated in FIG. 8, a uniform 2×2 blur kernel proves sufficient. However, as with rank-1 spatial superresolution, Equations (6) and (7) support spatiotemporal superresolution without any optical blurring, albeit with the introduction of reconstruction artifacts.

Exemplary Software Implementation

The multiplicative update rules (Equation (4)) and the WWRI method (Algorithm 1 in Table 1) can be implemented in a software program configured for spatial superresolution with dual-layer displays in Matlab or any other suitable programming language. In one embodiment, the program is be configured to support arbitrary numbers of frames (i.e., factorization ranks) The fast rank-1 solver can be implemented using CUDA to leverage GPU acceleration (source code is provided in Table 6). All factorizations were performed on an Intel 3.2 GHz Intel Core i7 workstation with 8 GB of RAM and an NVIDIA Quadro K5000. The fast rank-1 solver maintains the native 60 Hz refresh rate, including overhead for rendering scenes and applying post-processing fragment shaders (e.g., in an HMD demonstration).

Data processing and operations of cascaded displays need the physical configuration of the display layers and their radiometric characteristics, e.g., to compute the pixel overlaps encoded in W in Equation 2. Misalignment among the display layers can be corrected in a calibration process, for example, by warping the image displayed on the second layer to align with the image displayed on the first layer.

For instance, two photographs are used estimate this warp. In each photograph, a checkerboard is displayed on one layer, while the remaining layer is set to be fully transparent or fully reflective. Scattered data interpolation estimates the warping function that projects photographed first-layer checker-board corners into the coordinate system of the image displayed on the second layer. The second-layer checkerboard (or any other image) is warped to align with the first-layer check-board. In addition, radiometric characteristics are measured by photographing flat field images; these curves are inverted such that each display is operated in a linear radiometric fashion. Thus, the geometric and radiometric calibration is used to rectify the captured images and correct vignetting—allowing direct comparison to predicted results.

Exemplary Hardware Implementations

A cascaded display device according to the present disclosure can be implemented as a dual-layer LCD screen, supporting direct-view and head-mounted display (HMD) device, a dual-layer LCoS projector, etc. Operating cascaded displays to achieve superresolution advantageously places fewer practical restrictions: no physical gap is required between the layers, enabling thinner form factors, and significantly fewer time-multiplexed frames are necessary to eliminate image artifacts.

Figure 9:
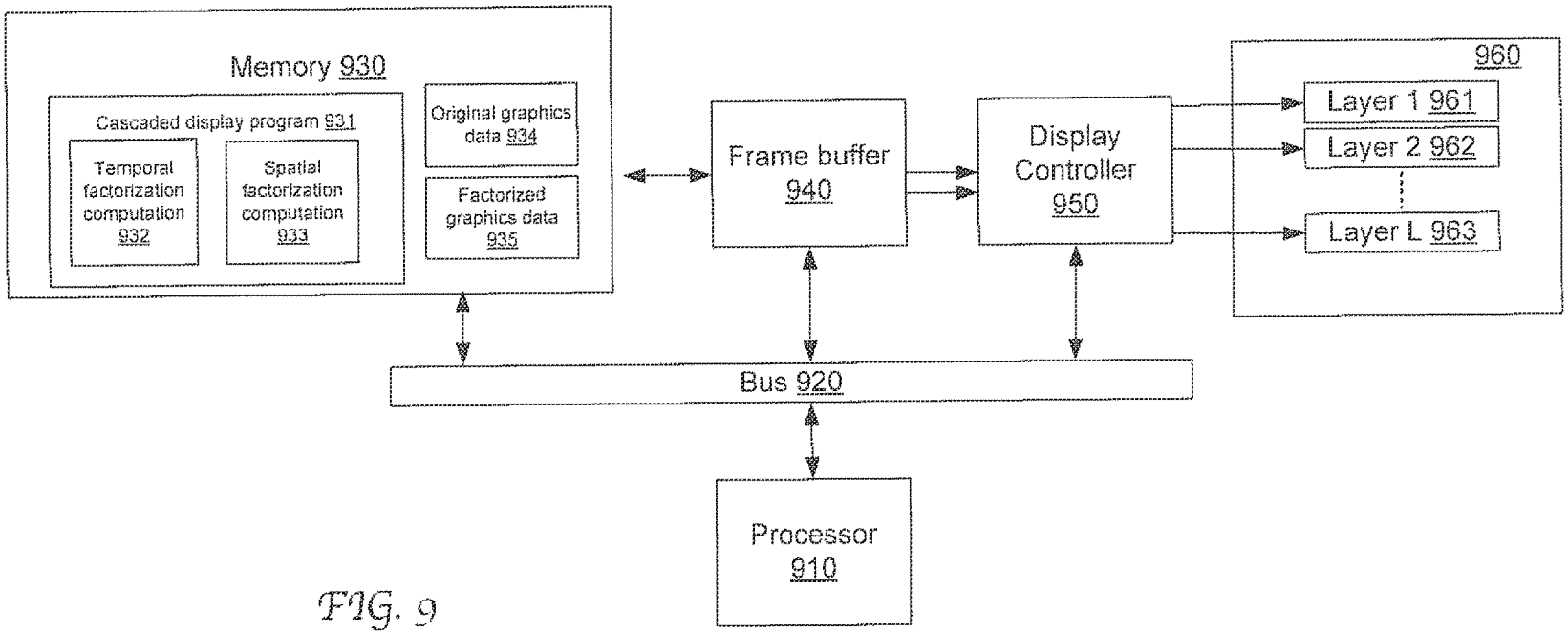
FIG. 9 illustrates an exemplary display system utilizing cascaded display layers and to achieve spatial/temporal superresolution in accordance with an embodiment of the present disclosure.

FIG. 9 illustrates an exemplary display system 900 utilizing cascaded display layers 961 and 962 to achieve spatial/temporal superresolution in accordance with an embodiment of the present disclosure. The system 900 includes a processor 910 (e.g. a graphics processing unit (GPU)), a bus 920, memory 930, a frame buffer 940, a display controller 950 and the display assembly 960 including display panels 961 and 962. It will be appreciated that the system 900 may also include other components, such as an enclosure, interface electronics, an IMU, magnifying optics, etc.

The memory 930 stores a cascaded display program 931, which may be an integral part of the driver program for the display assembly 960. The memory 930 also stores the original graphics data 934 and the factorized graphics data 935. The cascaded display program 931 includes a module 932 for temporal factorization computation and a module 933 for spatial factorization computation. Provided with user configurations and original graphics data 934, the cascaded display program 931 derives factorized image data 935 for display on each display layer 961 and 962, as described in greater detail herein. For example, the temporal factorization module 932 is configured to perform a process according to Equations (5)-(7); and the spatial factorization module 933 is configured to perform a process according to Equations (3) and (4).

A cascaded display device according to the present disclosure can be implemented as an LCD used in a direct-view or head-mounted display (HMD) application. The display device may include a stack of LCD panels, interface boards, a lens attachment (for HMD use), and etc. For instance, each panel is operated at the native resolution of 1280×800 pixels and with a 60 Hz refresh rate. However, the present disclosure is not limited by the purposes or application utilizing cascaded display. The present disclosure is not limited by the type of display panels or configuration or arrangement of the multiple layers in cascaded display.

In some embodiments, a cascaded display device includes LCD panel(s) and organic light-emitting diode (OLED) panel(s), electroluminescent display panel(s) or any other suitable type of display layer(s), or a combination therefore.

Figure 10A:
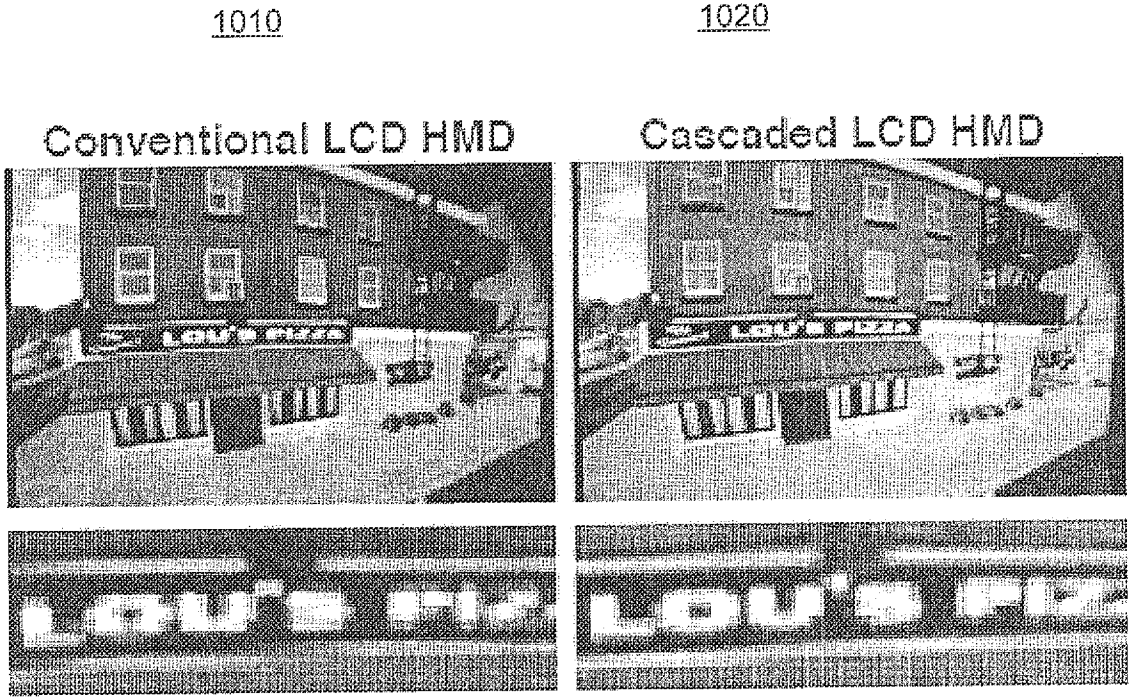
FIG. 10A shows a sample image captured through the magnifying optics of an exemplary HMD using the real-time rank-1 factorization in accordance with an embodiment of the present disclosure.

A cascaded LCD display according to the present disclosure supports direct viewing from a distance, as with a mobile phone or tablet computer, and HMD using appropriate lens attachment. FIG. 10A shows a sample image captured through the magnifying optics of an exemplary HMD using the real-time rank-1 factorization in accordance with an embodiment of the present disclosure. The legibility of text using the cascaded LCD (shown by diagram 1020) is apparently better in comparison to a conventional (low-resolution) display (shown by diagram 1010).

All spatial superresolution results presented herein were captured using a Canon EOS 7D camera with a 50 mm f/1.8 lens. Temporal superresolution results, included in the supplementary video, use a Point Grey Flea3 camera with a Fujinon 2.8-8 mm varifocal lens. Due to the gap between the LCD modulation layers, the lateral offset will appear to shift depending on viewer location. The calibration procedure described above is used to compensate for the parallax. The display layer patterns are displayed at a lower resolution than the native panel resolution, allowing direct comparison to "ground truth" superresolved images.

In one embodiment, a head-mounted display (HMD) according to the present disclosure additionally includes a lens assembly (e.g., a pair of aspheric magnifying lenses) disposed away from the top LCD by by slightly less than their 5.1 cm focal length in order to synthesize a magnified, erect virtual image appearing near "optical infinity." Head tracking is supported through the use of an inertial measurement unit (IMU). The GPU-accelerated fast WRRI solver can be used to process data for display in the HMD. This implementation is able to maintain the native 60 Hz refresh, including the time required to render the OpenGL scene, apply a GLSL fragment shader to warp the imagery to compensate for spherical and chromatic aberrations, and to factorize the resulting target image. Unlike direct viewing, an HMD allows a limited range of viewing angles—reducing the influence of viewer parallax and facilitating practical applications of cascaded LCDs.

Superresolution by cascaded displays may also be applied in cascaded liquid (LCoS) projectors, e.g., in compliance with 8K UHD cinematic projection standards. An exemplary LCoS projector includes multiple LCoS microdisplays, interface electronics, a relay lens, PBS, an aperture, projection lens, and an illumination engine, etc. These displays were operated at their native resolution of 1024×600 pixels, at a refresh rate of 60 Hz, an aperture ratio of 95.8% and reflectivity of 70%. The relay lens is used to achieve dual modulation by projecting the image of the first LCoS onto the second with unit magnification. The PBS cube can be positioned between the relay lens and second LCoS, replacing the original PBS plate. The dual-modulated image was projected onto a screen surface using projection optics.

Figure 10B:
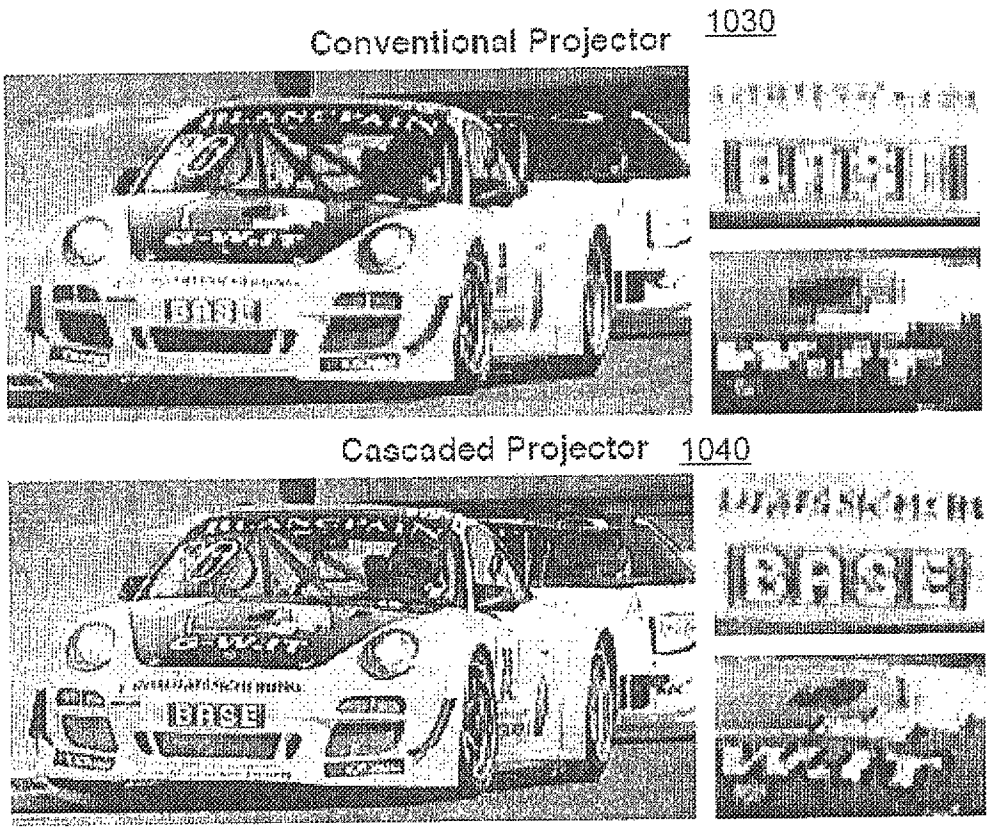
FIG. 10B shows sample photographs captured of image frames displayed on an exemplary cascaded LCoS projector in accordance with an embodiment of the present disclosure.

FIG. 10B shows sample photographs 1040 captured of image frames displayed on an exemplary cascaded LCoS projector in accordance with an embodiment of the present disclosure. The image 1040 shown on the cascaded LCoS projector shows improved legibility from the image 1030 projected using a conventional (low-resolution) LCoS projector.

The LCoS panels according the present disclosure can be positioned off-axis to prevent multiple reflections. If the two LCoS panels are perpendicular to, and centered along, the optical axis of the relay lens, then light can be reflected back to the first LCoS from the PBS cube, leading to experimentally-observed aberrations. Laterally shifting the LCoS panels away from the optical axis can reduce or eliminate these artifacts. The aperture is placed in front of the first LCoS to prevent any reflected light—now offset from the optical axis—from continuing to propagate.

Cascaded display techniques disclosed herein can also be applied in cascaded printed films. Printed semi-transparent color films can be reproduced using the patterns provided with the supplementary material. Only single-frame (i.e., rank-1) factorizations need to be presented with static films.

Weighted Nonnegative Matrix Factorization (WNMF)

This section presents exemplary embodiments for formulating the WNMF problems for various spatial superresolution applications according to the present disclosure.

Given a non-negative matrix represented as $$T \in \mathbb{R}_+^{m \times n},$$

and a target rank r<min(m, n), the following is to be solved:

$$A_{opt}, B_{opt} = \underset{A \in \mathbb{R}_+^{m \times r}, B \in \mathbb{R}_+^{n \times r}}{\operatorname{argmin}} \frac{1}{2} \| T - AB^T \|_W^2 \tag{S.1}$$

-continued $$= \underset{A\in\mathbb{R}_+^{m\times r},B\in\mathbb{R}_+^{n\times r}}{\operatorname{argmin}} \frac{1}{2}\|W\circ T - W\circ AB^T\|_F^2$$

Exemplary WNMF algorithms used for solving Equation (S.1) are compared in this disclosure, including weighted multiplicative update rules (herein referred to as "Blondel"), the weighted rank-one residue iteration (WRRI) method, and an alternating least-squares Newton (ALS-Newton) method.

FIG. 11 are data plots comparing performances of the exemplary WNMF methods with double precision factorization used for superresolution in a cascaded display in accordance with an embodiment of the present disclosure. The data presented in diagram 1110 shows objective function versus iteration, and the data presented in diagram 1120 shows PSNR versus iteration.

In example presented in FIG. 11, each of the three WNMF methods is used to factorize a target HD image (1576×1050 pixels) into a rank-1 dual-layer representation. Each method was implemented using double precision floating point numbers. All three methods achieve similar results after a few iterations, and WRRI achieves better quality when a small number of iterations are applied.

Figure 12:
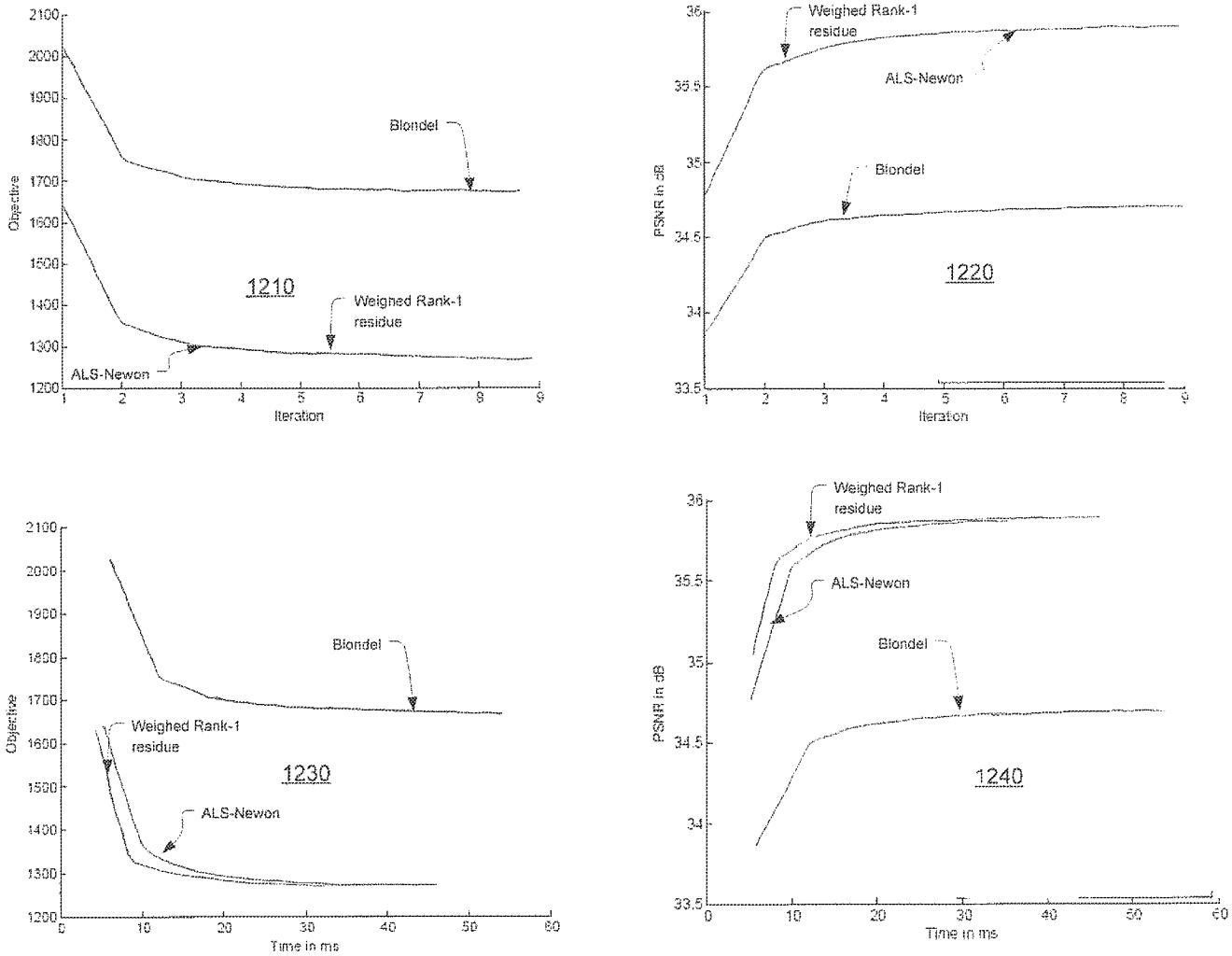
FIG. 12 are data plots comparing performances of the exemplary WNMF methods with single precision factorization used for superresolution in cascaded display in accordance with an embodiment of the present disclosure.

FIG. 12 are data plots comparing performances of the exemplary WNMF methods with single precision factorization used for superresolution in cascaded display in accordance with an embodiment of the present disclosure. As is evident, the Blondel update rules are numerically less stable than WRRI and ALS-Newton. All three methods are implemented on a GPU to compare actual run-time. The results show WRRI produces better factorizations in less time compared to the other two methods. It is the fastest due to fewer required memory accesses (2× less than the other methods). In this example, ALS-Newton is fast for rank-1 when it is adapted it to a specific problem of for rank-1 factorizations.

Table 2 lists the performance we achieve when running three iterations with each method for a 1576×1050 frames (timings averaged over 10 frames):

TABLE 2

| Method | Newton | WRRI | Blondel |
|---|---|---|---|
| Time in [ms] | 15.554 | 12.256 | 18.053 |
| FPS | 64.3 | 81.6 | 55.4 |

The following presents formulation of an exemplary WNMF process for joint spatiotemporal superresolution optimization.

If every pixel value is stacked at every staggered refresh time in a large vector for each layer, the spatio-temporal layer reconstruction is modeled as a weighted rank-1 NMF problem. Assume a non-negative matrix is given as $$T\in\mathbb{R}_+^{m\times n},$$

the problem is then formulated as the following Equation (S.2)

$$a_{opt}, b_{opt} = \underset{a\in\mathbb{R}_+^{m},b\in\mathbb{R}_+^{n}}{\operatorname{argmin}} \frac{1}{2}\|T - CP_1ab^TP_2\|_W^2 \tag{S.2}$$

-continued $$= \underset{a\in\mathbb{R}_+^{m},b\in\mathbb{R}_+^{n}}{\operatorname{argmin}} \frac{1}{2}\|W\circ T - W\circ CP_1ab^TP_2\|_F^2$$

The vectors a, b contain all layer pixels over all timesteps. The matrices $P_1$, $P_2$ are permutation matrices, where $P_1$ will permute the rows of the $ab^T$ which contains all possible spatial and temporal layer interactions (forward and backward in time). The matrix $P_2$ will permute the columns of this matrix. Together they permute $ab^T$, so that the resulting matrix contains the stacked image corresponding to a particular time-step in one column. The weight matrix W assigns 0 to the large parts of this matrix, which correspond to no layer interaction. The matrix C is a potential blur applied to the superresolved image (e.g., a diffuser). A small blur allows an additive spatial coupling of nearby pixels.

After describing the spatiotemporal optimization problem (Equation (S.2)), the next step is to derive matrix factorization update rules. For simplicity, the multiplicative NMF rules (S.3) can be used, including weight-adaption. It will be appreciated that this derivation can be applied to other NMF algorithms straightforwardly. As presented earlier, the NMF rules for Equation (S.1) was $$B \leftarrow B\circ\frac{(W\circ T)^TA}{(W\circ AB^T)^TA},\ A \leftarrow A\circ\frac{(W\circ T)B}{(W\circ AB^T)B}. \tag{S.3}$$

where the double lines denotes element-wise division. The generalization of the NMF problem can utilize the following simpler derivation by substituting $$A := CP_1a$$

$$B := (b^TP_2)^T = P_2^Tb \tag{S.4}$$

Thus, Equation (S.3) becomes $$\begin{aligned} B = P_2^Tb &\leftarrow P_2^Tb\circ\frac{(W\circ T)^T(CP_1a)}{(W\circ CP_1ab^TP_2)^T(CP_1a)} \\ &\Leftrightarrow P_2P_2^Tb \leftarrow P_2P_2^Tb\circ\frac{P_2(W\circ T)^T(CP_1a)}{P_2(W\circ CP_1ab^TP_2)^T(CP_1a)} \\ &\Leftrightarrow b \leftarrow b\circ\frac{P_2(W\circ T)^T(CP_1a)}{P_2(W\circ CP_1ab^TP_2)^T(CP_1a)} \\ &\Leftrightarrow b \leftarrow b\circ\frac{(P_1^TC^T(W\circ T)P_2^T)^Ta}{(P_1^TC^T(W\circ CP_1ab^TP_2)P_2^T)^Ta} \end{aligned} \tag{S.5}$$

Line three follows because permutations matrices have the property of $$P^{-1} = P^T.$$

The last line shows that the updated equation can be computed efficiently in parallel. The updates for a follows from symmetry $$a \leftarrow a\circ\frac{(P_1^TC^T(W\circ T)P_2^T)b}{(P_1^TC^T(W\circ CP_1ab^TP_2)P_2^T)b} \tag{S.6}$$

The derivation using Equation (S.4) can be applied analogously to the WRRI update rules.

The following embodiment employs an exemplary real-time rank-1 factorization process using an ALS-Newton method. According to the present disclosure, the exemplary ALS-Newton method is optimized for specific superresolution problems, especially for rank-1 factorization.

For rank r=1, a general nonnegative matrix factorization problem from Eq. (S.1) is simplified to:

$$a_{opt}, b_{opt} = \underset{a\in\mathbb{R}_+^m, b\in\mathbb{R}_+^n}{\operatorname{argmin}} \frac{1}{2}\|T - ab^T\|_W^2 \tag{S.7}$$

In an alternating least squares scheme, one solves the biconvex problem from above by alternately solving for one of the two variables a, b while fixing the other one and iterating, as represented in Table 3.

TABLE 3

| | | |
|---|---|---|
| 1: | $k = 0,\ a_{opt}^0 = a_{init},\ b_{opt}^0 = b_{init}$ | |
| 2: | repeat | |
| 3: | $b_{opt}^{k+1} := \underset{b\in\mathbb{R}_+^n}{\operatorname{argmin}} \frac{1}{2}\|T - ab^T\|_W^2$ | ▷ b-step |
| 4: | $a_{opt}^{k+1} := \underset{a\in\mathbb{R}_+^m}{\operatorname{argmin}} \frac{1}{2}\|T - ab^T\|_W^2$ | ▷ a-step |
| 5: | $k := k + 1$ | |
| 6: | until Optimality achieved | |

For r=1, the non-negativity constraints $$b\in\mathbb{R}_+^n \text{ and } a\in\mathbb{R}_+^m.$$

can be removed in steps 3 and 4. After the unconstrained (and hence convex) sub-problem in Table 1, the solution can be projected to a non-negative solution with the same objective function value or by flipping the signs of the negative elements (assuming that the previous solution does not harm the constraint as well). So an algorithm for the unconstrained rank-1 ALS WNMF process can be derived, as presented in Table 4

TABLE 4

| | | |
|---|---|---|
| 1: | $k = 0,\ a_{opt}^0 = a_{init};\ b_{opt}^0 = b_{init}$ | |
| 2: | repeat | |
| 3: | $b_{opt}^{k+1} := \underset{b}{\operatorname{argmin}} \frac{1}{2}\|T - ab^T\|_W^2$ | ▷ b-step |
| 4: | $b_{opt}^{k+1} := \operatorname{sign}(b_{opt}^{k+1}) \circ b_{opt}^{k+1}$ | |
| 5: | $a_{opt}^{k+1} := \underset{a}{\operatorname{argmin}} \frac{1}{2}\|T - ab^T\|_W^2$ | ▷ a-step |
| 6: | $a_{opt}^{k+1} := \operatorname{sign}(a_{opt}^{k+1}) \circ a_{opt}^{k+1}$ | |
| 7: | $k := k + 1$ | |
| 8: | until Optimality achieved | |

Thus far, a non-convex problem has been formulated as a sequence of convex optimization problems. The "b-step" in Table 4 can be solved using Newton's method having quadratic convergence. As a result, the gradient and Hessian of f(b) is derived with $$\begin{aligned} b_{opt} &= \underset{b}{\operatorname{argmin}} \frac{1}{2}\|T - ab^T\|_W^2 \\ &= \underset{b}{\operatorname{argmin}} \frac{1}{2}\|D_W t - D_W O_a b\|_F^2 \\ &= \underset{b}{\operatorname{argmin}} \frac{1}{2}(t^T D_W^T D_W t - 2t^T D_W^T D_W O_a b + O_a^T D_W O_a b) \\ &= \underset{b}{\operatorname{argmin}} \underbrace{\frac{1}{2}(t^T D_W^2 t - 2t^T D_W^2 O_a b + O_a^T D_W O_a b)}_{f(b)} \end{aligned} \tag{S.8}$$

where the matrices $D_{(\bullet)}$ is introduced, which puts the matrix from the subscript on the diagonal. Also introduced is the matrix $O_{(\bullet)}$, which corresponds to the outer vector product operation with the vector in the subscript and the rhs, followed by vectorization. The second line allows to remove the Frobenius norm and so the gradient and Hessian of f are easily derived. For the gradient, it is represented as $$\begin{aligned} \nabla f &= O_a^T D_W O_a b - O_a^T D_W^2 t \\ &= O_a^T D_{W\circ(ab^T) - W\circ W\circ T} 1 \end{aligned} \tag{S.9}$$

The operator $O^T$ is the same as the outer vector product operation plus subsequent summation over the rows of the resulting matrix. So it simply needs to do the point-wise operation $W\circ abT - W\circ W\circ T$, do the outer product with a, sum over the rows of the corresponding matrix, which yields then the gradient with respect to b.

For the Hessian, a diagonal matrix is obtained with $$\begin{aligned} \frac{\partial^2 f}{\partial b^2} &= O_a^T D_W O_a \\ &= O_a^T D_{W\circ(a\cdot 1T)} \end{aligned} \tag{S.10}$$

Since the Hessian is a diagonal matrix $$H(f) = D_{\frac{\partial^2 f}{\partial b^2}},$$

the inverse in Newton's method becomes simply a point-wise division. Table 5 shows an exemplary process for full Newton for rank-1, which can be used to implemented the process shown in Table 4.

TABLE 5

| | | |
|---|---|---|
| 1: | repeat | |
| 2: | $b_{opt}^{k+1} := b_{opt}^{k+1} - \frac{v_f}{\frac{\partial^2 f}{\partial b^2}}$ | Pointwise division |
| 3: | $k := k + 1$ | |
| 4: | until Optimality achieved | |

Table 6 shows an exemplary real-time CUDA code for rank-1 factorization, which supports three different update rules, Blondel, WRRI, and ALS-Newton. The code includes two kernels. One computes the nominator (or gradient) and denominator (or Hessian) for an update for a considered layer. Another one performs the update given those components.

TABLE 6

```
1
2   ////////////////////////////////////////////////////////////////////////////////
3   // rank-1 matrix factorization for NMF, WRRI, ALS Newton
4   ////////////////////////////////////////////////////////////////////////////////
5
6   //Computes denominator(or hessian) [d_denom] and nominator(or gradient) [d_nom] for update rules for
7   //layer A [d_A] or layer B [d_B] given the fragments (for numCh color channels).
8
9   //The integrated fragment color values [d_samples], their normalized area [d_weights] and
10  //intersection indices on each layer [d_layerInt] are given for the fragments.
11
12  //The kernel supports NMF (method == 0), WRRI (method == 1), NEWTON (method == 2)
13
14  static ___global___ void factorization_kernel( float *d_A, float *d_B, int width_layer, int height_layer,
                int numCh, float* d_samples, float* d_weights, int numFragments, int* d_layerInt, int ABflag,
            float *d_denom, float* d_nom, int method)
15  {
16      //Vars
17      float denom, nom, a_curr, b_curr, t_curr, w_curr, val ;
18      int layerAIdx, layerBIdx;
19
20      //Parallel over fragments
21      int fch = blockIdx.x * blockDim.x + threadIdx.x;
22      for (; fch < numFragments * numCh; fch += gridDim.x * blockDim.x)
23      {
24              //Indices
25              int f = fch % numFragments;
26              int ch = fch / numFragments;
27
28              //Channel offset
29              int chOffLayer = ch * (width_layer * height_layer);
30
31              //For current fragment extract indices on both layers and the fragments area
32              layerAIdx = d_layerInt[2 * f + 0];
33              layerBIdx = d_layerInt[2 * f + 1];
34
35              //Target image fragment value
36              t_curr = d_samples[fch];
37              a_curr = d_A[chOffLayer + layerAIdx];
38              b_curr = d_B[chOffLayer + layerBIdx];
39              w_curr = d_weights[f];
40
41              //Update and accumulate
42              if( ABflag == 0 ) //Update A (ABflag == 0), or update B (ABflag != 0)
43              {
44                  if( method == 0 )
45                  {
46                      //#### NMF
47                      denom = (a_curr * b_curr * w_curr) * b_curr; //Denominator wrt A
48                      nom = b_curr * (t_curr * w_curr); //Nominator wrt A
49                  }
50                  else if( method == 1 )
51                  {
52                      //#### WRRI
53                      denom = (b_curr * b_curr) * w_curr; //Denominator wrt A
54                      nom = b_curr * (t_curr * w_curr); //Nominator wrt A
55                  }
56                  else if( method == 2 )
57                  {
58                      //#### NEWTON
59                      nom = a_curr * (b_curr * b_curr) * w_curr − b_curr * t_curr * w_curr * w_curr ; //Grad wrt
                            A
60                      denom = b_curr * b_curr * w_curr; //Hessian wrt A
61                  }
62
63                  //Accumulate
64                  atomicAdd( &(d_denom[chOffLayer + layerAIdx]), denom);
65                  atomicAdd( &(d_nom[chOffLayer + layerAIdx]), nom);
66              }
67              else
68              {
69                  if( method == 0 )
70                  {
71                      //#### NMF
72                      denom = a_curr * (a_curr * b_curr * w_curr); //Denominator wrt B
73                      nom = a_curr * (t_curr * w_curr); //Nominator wrt B
74                  }
```

TABLE 6-continued

```
75                      else if( method == 1 )
76                      {
77                          //#### WRRI
78                          denom = (a_curr * a_curr) * w_curr; //Denominator wrt B
79                          nom = a_curr * (t_curr * w_curr); //Nominator wrt B
80                      }
81                      else if( method == 2 )
82                      {
83                          //#### NEWTON
84                          nom = (a_curr * a_curr) * b_curr * w_curr − a_curr * t_curr * w_curr * w_curr; //Grad wrt↩
                                B
85                          denom = a_curr * a_curr * w_curr; //Hessian wrt B
86                      }
87
88                      //Accumulate
89                      atomicAdd( &(d_denom[chOffLayer + layerBIdx]), denom);
90                      atomicAdd( &(d_nom[chOffLayer + layerBIdx]), nom);
91                  }
92
93              }
94  }
95
96
97  //Updates the layers A [d_A] or layer B [d_B] given the previously computed
98  //denominator( or hessian) [d_denom] and nominator(gradient) [or d_nom ].
99
100 //The kernel supports NMF (method == 0), WRRI (method == 1), NEWTON (method == 2)
101 //The arrays d_denom and d_nom are reset afterwards.
102
103 static ___global___ void update_kernel( float *d_A, float *d_B, int width_layer, int height_layer , int↩
            numCh, float *d_denom, float* d_nom, int ABflag, int method )
104 {
105     //Vals
106     float val, nom, denom;
107
108     //Parallel over output
109     int xych = blockIdx.x * blockDim.x + threadIdx.x;
110     for (; xych < width_layer * height_layer * numCh; xych += gridDim.x * blockDim.x)
111     {
112
113                 //Nom and denom
114                 denom = d_denom[xych];
115                 nom = d_nom[xych];
116
117                     //Get current val and do update
118                 if( ABflag == 0 )
119                 {
120
121                     if( method == 0 )
122                     {
123                         //#### NMF
124                         val = d_A[xych];
125                         d_A[xych] = fminf( fmaxf( val * fmaxf(nom, 1.0E−9) / (denom + 1.0E−9), 0.f ), 1.f );
126                     }
127                     else if( method == 1 )
128                     {
129                         //#### WRRI
130                         //Write
131                         if( denom <= 0 )
132                         {
133                             d_A[xych] = 0.f;
134                         }
135                         else
136                         {
137                             d_A[xych] = fminf( fmaxf( fmaxf(nom,0.f) / denom, 0.f), 1.f );
138                         }
139                     }
140                     else if( method == 2 )
141                     {
142                         //#### NEWTON
143                         //Write
144                         val = d_A[xych];
145                         d_A[xych] = fminf( fmaxf( val − nom/denom, 0.f), 1.f );
146                     }
147
148                 }
```

TABLE 6-continued

```
149                 else
150                 {
151
152                     if( method == 0 )
153                     {
154                         //#### NMF
155                         val = d_B[xych];
156                         d_B[xych] = fminf( fmaxf ( val * fmaxf(nom, 1.0E−9) / (denom + 1.0E−9), 0.f), 1.f );
157                     }
158                     else if( method == 1 )
159                     {
160                         //#### WRRI
161                         //Write
162                         if( denom <= 0 )
163                         {
164                             d_B[xych] = 0.f;
165                         }
166                         else
167                         {
168                             d_B[xych] = fminf( fmaxf( fmaxf(nom,0.f) / denom, 0.f), 1.f );
169                         }
170                     }
171                     else if( method == 2 )
172                     {
173                         //#### NEWTON
174                         //Write
175                         val = d_B[xych];
176                         d_B[xych] = fminf( fmaxf( val − nom/denom, 0.f), 1.f );
177                     }
178
179                 }
180
181                 //Reset nom and denom
182                 d_denom[xych] = 0.f;
183                 d_nom[xych] = 0.f;
184         }
185     }
```

The following embodiment employs an exemplary nonnegative tensor factorization process for multi-layer cascaded displays configured for superresolution.

As discussed above, multi-layer cascaded displays may use a weighted nonnegative tensor factorization (WNTF) in conjunction with multiplicative update rules. The generalized two-layer update rules are given by Equation (4).

A three-layer image formation model can be expressed as $$s_{i_1,i_2,i_3} = \sum_{k=1}^{K} w_{i_1,i_2,i_3}\left(a_{i_1}^{(k)} b_{i_2}^{(k)} c_{i_3}^{(k)}\right), \tag{S.11}$$

where it is assumed that a bottom layer has $I_1$ pixels, a middle layer has $I_2$ pixels, and a top layers with $I_3$ pixels. As discussed above, K time-multiplexed frames are rendered on the display device at a rate exceeding the critical flicker fusion threshold so that a viewer can perceive the presented images in a superresolution. The transmissivity of pixel $i_3$ in the top layer, for frame k, is denoted as $c_{i3}^{(k)}$ and $0 \le c_{i3}^{(k)} \le 1$. $w_{i1,i2,i3}$ denotes the cumulative overlap of pixels $i_1$, $i_2$, and $i_3$.

A tensor representation can be adopted for the image formation model. The canonical decomposition of an order-3, rank-K tensor can be defined as $$[[X, Y, Z]] := \sum_{k=1}^{K} x_k * y_k * z_k, \tag{S.12}$$

where start operator denotes the vector outer product and $\{x_k, y_k, z_k\}$ represent column k of their respective matrices. Equation (S.11) can be used to concisely express image formation by a three-layer cascaded display:

$$\mathcal{S} = \mathcal{W} \circ [[A, B, C]] = \mathcal{W} \circ \left(\sum_{k=1}^{K} a_k * b_k * c_k\right), \tag{S.13}$$

where $\mathcal{S}$ is a sparse tensor containing the effective emissivities of the subpixel fragments, W is also a sparse $I_1 \times I_2 \times I_3$ tensor tabulating the cumulative pixel overlaps, and $\circ$ denotes the Hadamard (element-wise) product. Observe that $\{a_k, b_k, c_k\}$ represent the pixel values displayed on their respective layers during frame k (e.g., in lexicographic order). Hence, matrix A equals the concatenation of the frames displayed on the first layer such that $A=[a_1, a_2, \ldots, a_K]$ (similarly for the other layers).

Given this image formation model, the objective function can be used for optimal three-layer factorizations:

$$\underset{\{0 \le A \le 1, 0 \le B \le 1, 0 \le C \le 1\}}{\operatorname{argmin}} \frac{1}{2} \|\mathcal{W} \circ (\beta \mathcal{T} - [[A, B, C]])\|_2^2. \tag{S.14}$$

where β is the dimming factor applied to the target subpixel fragment emissivities $W \circ T$. This objective can be minimized by application of the following multiplicative update rules $$A \leftarrow A \circ \left( \frac{(W_{(1)} \circ (\beta T_{(1)}))(C \odot B)}{(W_{(1)} \circ (A(C \odot B)^T))(C \odot B)} \right) \quad (S.15)$$

$$B \leftarrow B \circ \left( \frac{(W_{(2)} \circ (\beta T_{(2)}))(C \odot A)}{(W_{(2)} \circ (B(C \odot A)^T))(C \odot A)} \right) \quad (S.16)$$

$$C \leftarrow C \circ \left( \frac{(W_{(3)} \circ (\beta T_{(3)}))(B \odot A)}{(W_{(3)} \circ (C(B \odot A)^T))(B \odot A)} \right). \quad (S.17)$$

In the above expressions, $\odot$ expresses the Khatri-Rao product:

$$X \odot Y = [x_1 * y_1, x_2 * y_2, \ldots, x_K * y_K]. \quad (S.18)$$

$X_{(n)}$ is the unfolding of tensor X, which arranges the node-n fibers of X into sequential matrix columns. Generalization to higher factorization orders can be similarly derived.

Figure 13:
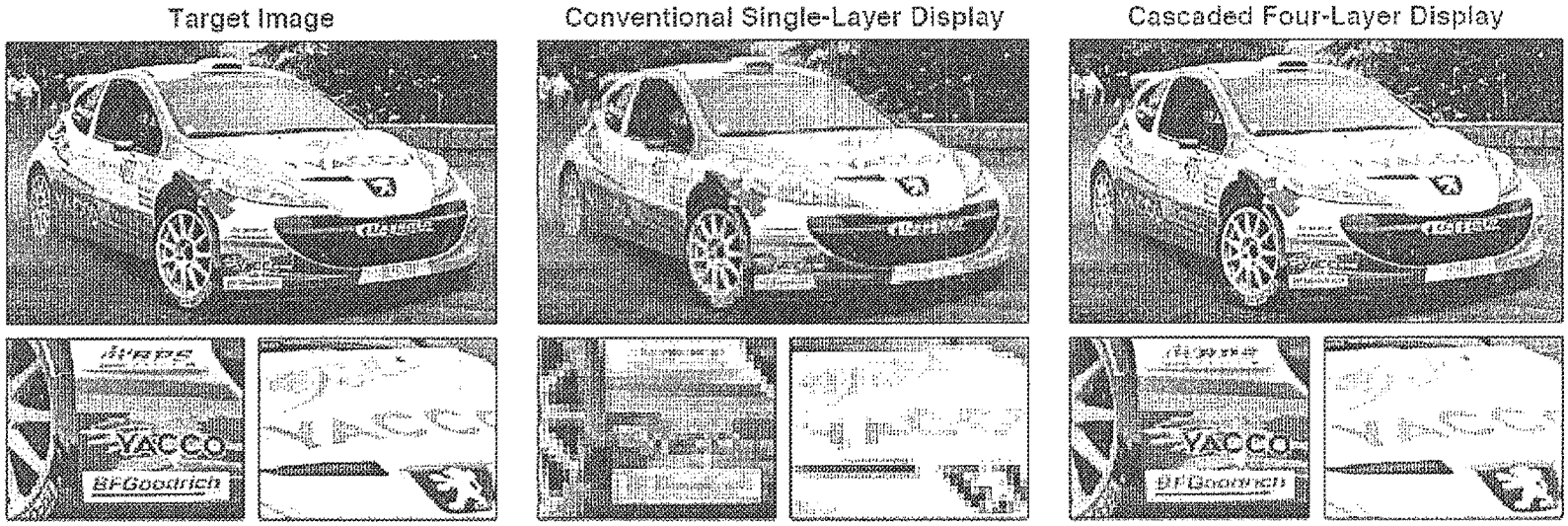
FIG. 13 shows captured images displayed on a cascaded four-layer display device using a two-frame factorization in accordance with an embodiment of the present disclosure.
Figure 14:
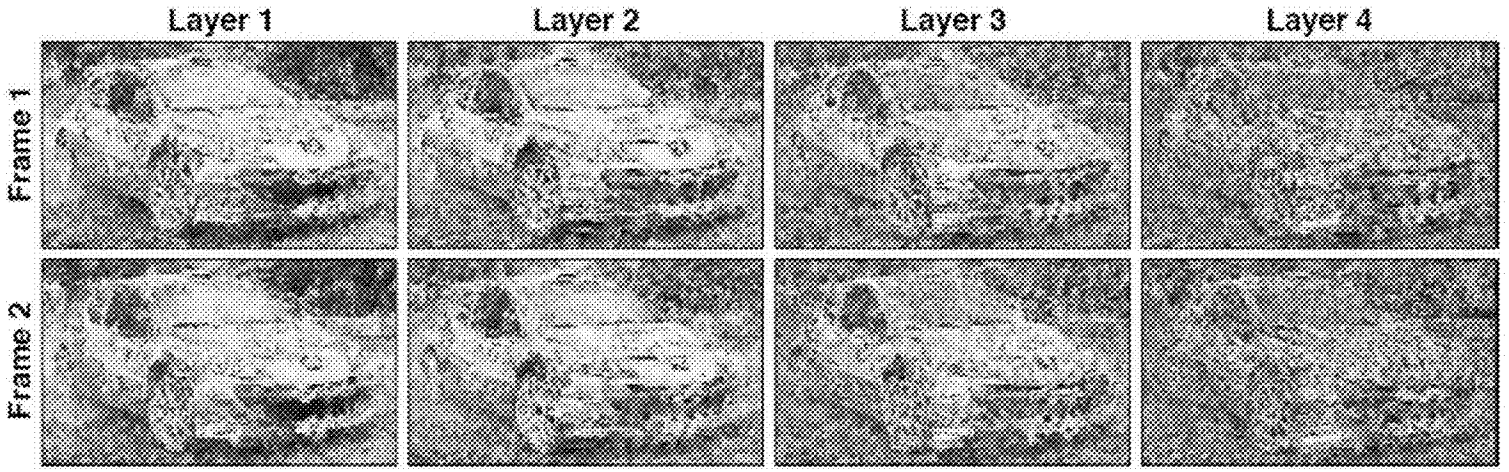
FIG. 14 shows factorized frames for individual layers for the exemplary cascaded four-layer display in FIG. 13.

FIG. 13 shows captured images displayed on a cascaded four-layer display device using a two-frame factorization in accordance with an embodiment of the present disclosure. FIG. 14 shows factorized frames for individual layers for the exemplary cascaded four-layer display in FIG. 13.

In this simulated example, the "drift" image was spatially superresolved by a factor of 16 using a stack of four light-attenuating layers, each shifted by ¼ of a pixel, along each axis. The target image, the depiction with a single (low-resolution) display layer, and the reconstruction using a cascaded four-layer display are shown from left to right. It shows that significant upsampling is achieved by the cascaded four-layer display.

In this example, the lateral offset is generalized to maximize the superresolution capability: by progressively shifting each layer by ¼ of a pixel and consequently creating 16 times as many subpixel fragments as pixels on a single layer. Using two-frame (i.e., order-4, rank-2) factorizations achieve high superresolution factors, as demonstrated by the fidelity of the inset regions in FIG. 13

In summary, a generalized framework is provided for cascaded displays that encompasses arbitrary numbers of offset pixel layers and numbers of time-multiplexed frame. For example, cascaded dual-layer displays provide a means to quadruple spatial resolution with practical display architectures supported by real-time factorization methods (e.g., the cascaded LCD screen and LCoS projector prototypes).

Color Filter Arrays for Cascaded Displays

LCD panels primarily achieve color display by the addition of a color filter array (CFA) composed of a periodic array of spectral bandpass filters. Typically, three neighboring columns of individually-addressable subpixels, illuminated by a white backlight, are separately filtered into red, green, and blue wavelength ranges, together representing a single full-color pixel column. At sufficient viewing distances, spatial multiplexing of color channels becomes imperceptible. In some embodiments, it has been observed that cascaded dual-layer LCDs can still double the vertical resolution when vertically-aligned CFAs are present on each layer. Whereas, increasing the horizontal resolution may be problematic without modifying the CFA structure.

Two modifications are presented herein to address the problems: the use of multiple color filters per pixel (on the top-most layer) and the use of cyan-yellow-magenta CFAs. Use of both can result in cascaded dual-layer LCDs that appear as a single LCD with twice the number of color subpixels along each axis.

As each subpixel fragment may depict a different color if it has an independent color filter, cascaded dual-layer LCDs can be constructed using monochromatic panels (e.g., those free of any color filter arrays). Offsetting such displays by half a pixel, both horizontally and vertically, creates four times as many subpixel fragments as pixels on a single layer. To create a spatially-multiplexed color display, a CFA having one color filter per subpixel fragment may be used. This can be achieved by fabricating one panel with a CFA with half the pitch as a conventional panel, such that two vertically-aligned color filters are present at each pixel in the outermost display panel. In this manner, rather than the larger layer pixels, each subpixel is individually filtered by the single custom CFA.

As an alternative, two LCD panels with identical color filter arrays can be used. FIG. 15 illustrates an exemplary method of creating subpixel fragments by dual-layer cascaded displays with cyan-yellow-magenta color filter arrays (CFAs). In this example, traditional red-greed-blue filters are replaced with cyan-yellow-magenta triplets for each layer (shown in 1510 and 1520). Thus, unlike conventional LCDs with red, green, and blue filters, the materials are capable of transmitting cyan, yellow, and magenta wavelength ranges. As depicted, the superposition of two dissimilar filters synthesizes red (i.e., combinations of magenta and yellow), green (i.e., combinations of cyan and yellow), and blue (i.e., combinations of cyan and magenta), as shown in diagram 1530.

Given a fixed CFA, a single filter can act on each column of pixels. Consider a pair of LCDs with periodic columns of cyan, yellow, and magenta filters, beginning with a cyan column on the left-hand side. The second panel can be positioned with an offset of one-and-a-half pixels to the right and half a pixel up or down (see FIG. 15). Such a configuration appears with twice as many subpixel fragments along each dimension, covered by what appears to be a conventional red-green-blue CFA with twice the pitch of the CFA in each layer.

For example, in the diagram 1510 showing the first layer with a CFA, the pixels ($a_1$-$a_3$) in the first column are cyan; the pixels ($a_4$-$a_6$) in the second column are yellow, the pixels ($a_7$-$a_9$) in the third column are magenta, and the pixels ($a_{10}$-$a_{12}$) in the fourth column are cyan. In the diagram 1520 showing a second light-absorbing display placed in direct contact with the rear display layer with an identical CFA, the pixels ($b_1$-$b_3$) in the first column are magenta; the pixels ($b_4$-$b_6$) in the second column are cyan, the pixels ($a_7$-$a_9$) in the third column are yellow, and the pixels ($a_{10}$-$a_{12}$) in the fourth column are magenta.

The diagram 1530 shows the geometric overlap of offset pixel layers creates an array of subpixel fragments. The spectral overlap of the color filters creates an effective CFA that appears as a traditional red-greed-blue filter pattern with twice the pitch as the underlying CFAs. More specifically, the subpixels in columns 1531, 1534 and 1537 are blue, the subpixels in columns 1532 and 1535 are red, and the subpixels in columns 1533 and 1536 are green.

This idea can be extended to other sub-pixel layouts and color filters, such as a 2×2-grid of cyan, yellow, magenta, and white. When offset by a quarter pixel in each dimension, the resolution increases by four times, but now have apparent cyan, yellow, magenta, red, green, blue, and white sub-pixels. It will be appreciated that the multi-layer cyan-yellow-magenta CFAs described herein is not all-encompassing, and is offered as an illustrative example.

As with the 2×2-grid, more general CFA patterns and filter band pass spectra can be used with the basic principle: overlapped CFAs can synthesize arbitrary target CFAs that modulate individual subpixel fragments, while utilizing existing display manufacturing processes that create a single color filter per pixel, per display layer.

In some other embodiments, the utilization of high-speed LCDs may eliminate the need for CFAs. Instead field-sequential color (FSC) is used, in which monochromatic panels sequentially display each color channel, while the backlight color is altered.

In still some other embodiments, the effective CFA could also be achieved simply by manufacturing one of the layers using a red-greed-blue CFA with twice the normal pitch, with no CFA placed in the other layer.

Exemplary Cascaded Display Performances

Figure 16:
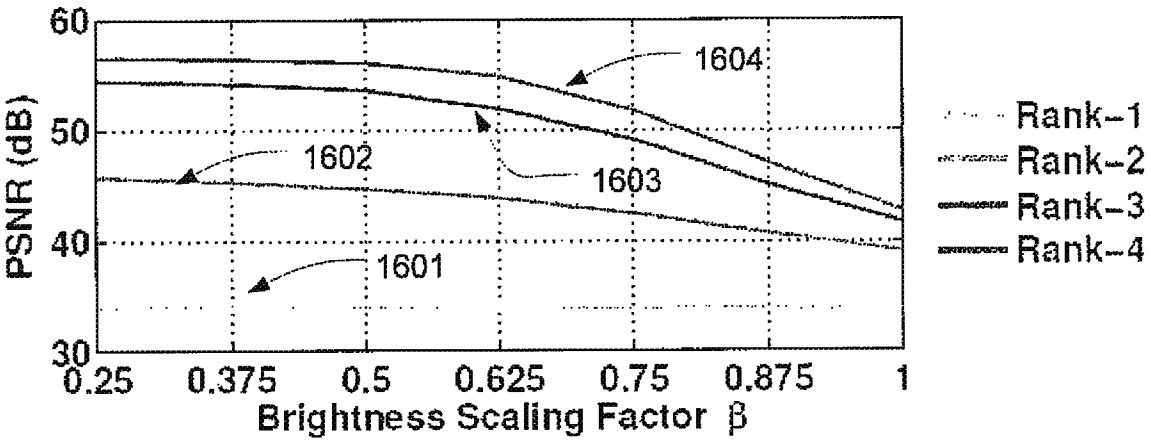
FIG. 16 shows data plots of the peak signal-to-noise ratios (PSNR) obtained as a function of the dimming factor $\beta$ at various parameters (averaged over the set of target images)

With respect to spatial superresolution, solutions of Equation (3) offer a display designer a flexible trade-off between apparent image brightness, spatial resolution, and refresh rate, as captured by the dimming factor β, the resolution of the target image W∘T, and the factorization rank K, respectively. FIG. 16 shows data plots of the peak signal-to-noise ratios (PSNR) obtained as a function of the dimming factor β at various parameters (averaged over the set of target images). The plots 1061, 1062, 1063 and 1064 correspond to rank-1, rank-2, rank-3 and rank 4 respectively. As demonstrated, high-PSNR reconstructions are obtained with a dimming factor of 0.25 and four frames (as shown by 1064). In this case, the heuristic factorization (as presented above with reference to FIG. 4) exactly reconstructs the target image. Three-frame factorizations (as shown by 1063) closely approach the performance achieved with four frames. Most significantly, FIG. 16 reveals a key insight: spatial superresolution (with a PSNR exceeding 30 dB) can be achieved at the native display refresh rate, without reducing the apparent brightness.

With respect to temporal superresolution, solutions of Equation (5) also offer flexible control between brightness, resolution, and refresh rate. Architectures intended for spatiotemporal superresolution may include an optical blurring element (characterized by the point spread function embedded in the convolution matrix C). In some embodiments, factorizations with 2×2-pixel uniform blur kernels are sufficient to render high-PSNR reconstructions for a variety of target videos, as described in greater detail below. However, in some other embodiments, effective superresolution can be achieved without added blur and therefore other diffuse elements need not be incorporated.

Several superresolution techniques according to the prior art are utilized to generate display results and compared with those generated from cascaded display system according to the present disclosure.

According to an additive superresolution display model in the prior art, a set of superimposed, shifted low-resolution images are presented, through vibrating displays and superimposed projections. It has been assumed that no motion blur is introduced which would further degrade image quality for vibrating displays.

An optical pixel sharing (OPS) approach according to the prior art is also used to generated images for comparison purposes. The OPS implementation requires specifying two tuning parameters: the edge threshold and the smoothing coefficient. Two dimensional grid search was used to optimize these parameters—independently for each target image—to maximize the PSNR or the SSIM index. In practice, ensemble-averaged tuning parameters are be used, increasing reconstruction artifacts. In contrast, cascaded displays according to the present disclosure do not require optimizing any such tuning parameters, further advantageously facilitating real-time applications.

The spatial light modulators used in each of these display alternatives may have variable pixel aperture ratios. As observed, limited aperture ratios translate to improved image quality for additive superresolution displays. However, spatial superresolution from additive superpositions is practically hindered due to the engineering challenges associated with limiting aperture ratios—particularly for superimposed projections. Furthermore, industry trends are pushing ever-higher aperture ratios (e.g., LCoS microdisplays and power-efficient LCDs). As a result, a 100% aperture ratio is assumed in all comparisons presented herein.

Several observations can be made from the visual comparisons and PSNR table. Foremost, for these examples, single-frame cascaded display factorizations closely approach or outperform all other methods utilizing two time-multiplexed frames. These PSNR advantages translate to visible reductions in artifacts.

Figure 17:
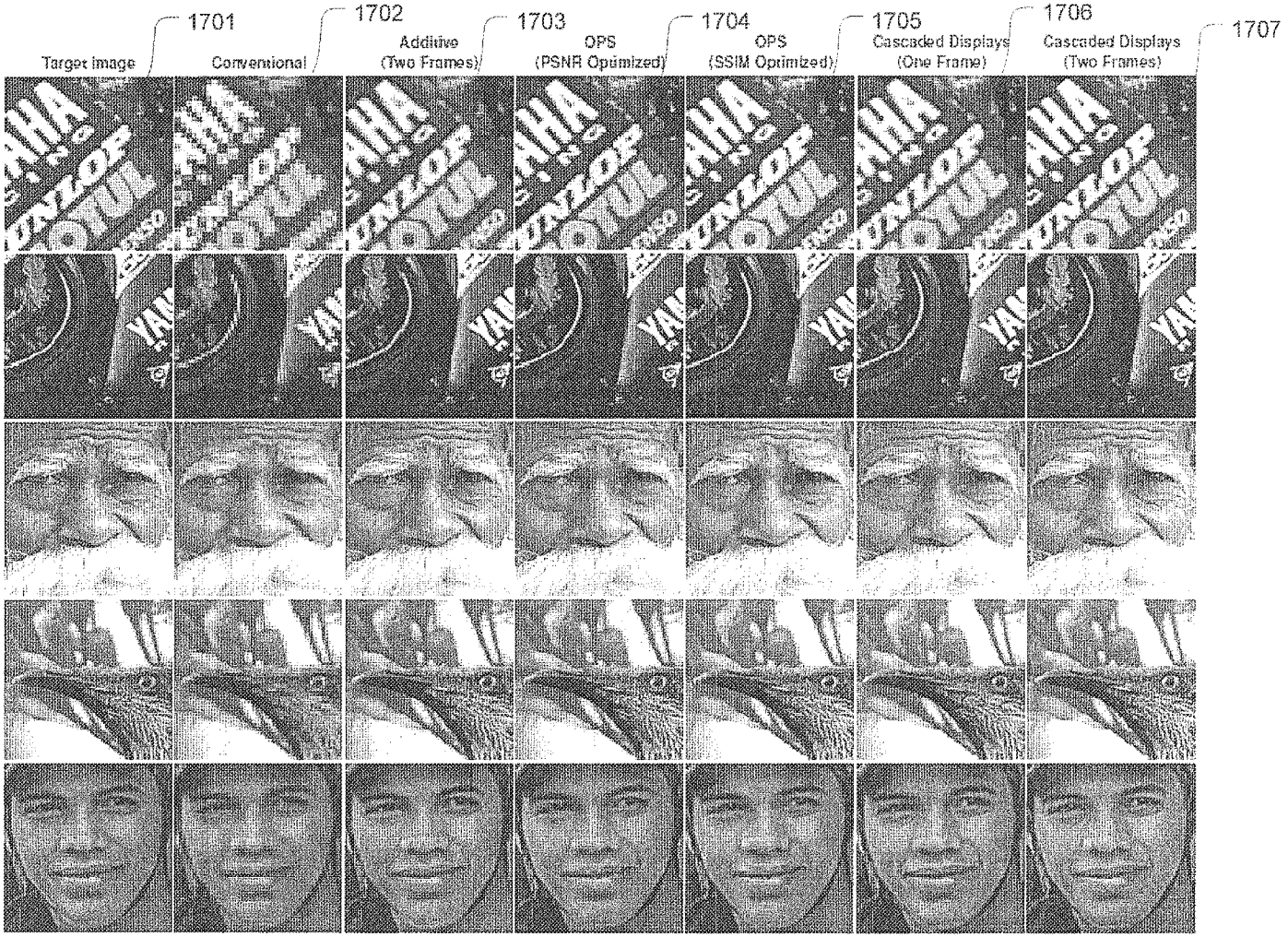
FIG. 17 shows visual comparison of superresolution displays by image patches reproduced with simulations of three different superresolution displays.

FIG. 17 shows visual comparison of superresolution displays by image patches reproduced with simulations of three different superresolution displays. The three superresolution displays include additive superresolution using two frames according to the prior art, OPS using two frames with per-image PSNR- and SSIM-optimized edge thresholds and smoothing coefficients according to the prior art, and cascaded displays using one or two frames according to the present disclosure.

Notice the enhancement relative to a conventional (low-resolution) display (column 1702). Cascaded displays (columns 1706 and 1707) significantly outperform optical pixel sharing (OPS) (columns 1704 and 1705), which relies on a similar dual-modulation architecture containing relay optics. Simulations of additive superresolution (columns 1703 and 1704) also appear to outperform OPS, under the assumption that no motion blur is used in the additive simulations.

Two-frame cascaded display factorizations (column 1707) outperform all other two-frame factorizations (e.g., column s 1703) by a significant margin and even four-frame additive superresolution. This highlights the benefits of the compressive capabilities enabled by our matrix-factorization-based approach.

The following expands on the PSNR analysis by comparing the modulation transfer functions (MTFs) characterizing each superresolution display alter-native: specifying the contrast of spatially-superresolved images, as a function of spatial frequency. The MTF of a display can be measured using a variety of test patterns, including natural image sets, spatial frequency chirps, and slanted edges. Here a chirped zone plate pattern is adopted and has form of $(1+\cos(cr^2))/2$, where $r=\mathrm{sqrt}(x^2+y^2)$, $\{x, y\}\epsilon[-\pi, \pi]$, and c controls the maximum spatial frequency.

FIG. 18 A shows simulated comparison of the MTF for display alternatives according to the prior and the cascaded displays according to the present disclosure. Single-frame cascaded displays effectively quadruple spatial resolution and perform on par with two-frame additive displays.

Figure 18A:
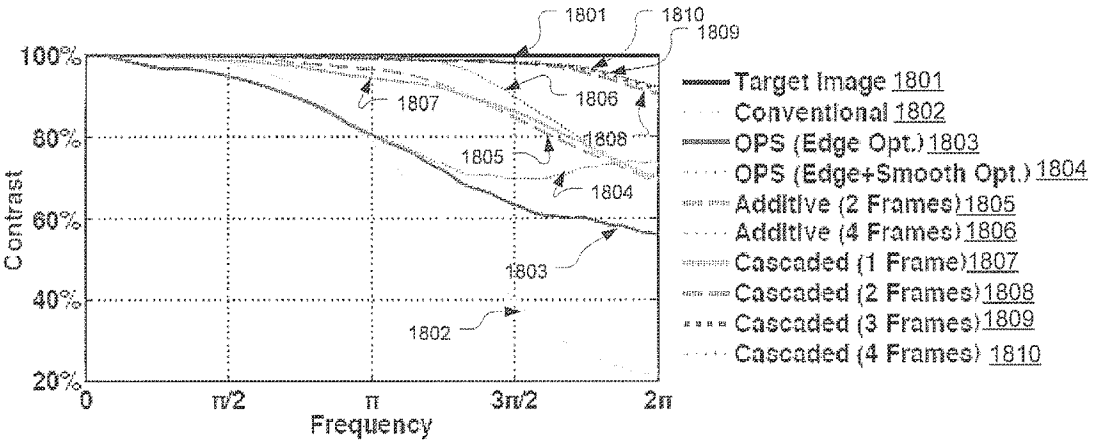
FIG. 18A shows simulated comparison of the MTF for display alternatives according to the prior and the cascaded displays according to the present disclosure.

MTF analysis confirms the earlier observations made regarding the relative performance of each approach. Furthermore, it reveals that single-frame cascaded displays effectively quadruple the spatial resolution (doubling it along each image dimension)—albeit with artifacts introduced by compression—maintaining greater than 70% contrast for the highest superresolved frequencies. FIG. 18A also shows that the MTFs for two-frame and three-frame factorizations are nearly identical, indicating that practical applications of cascaded display may require no more than a pair of time-multiplexed frames.

Figure 18B:
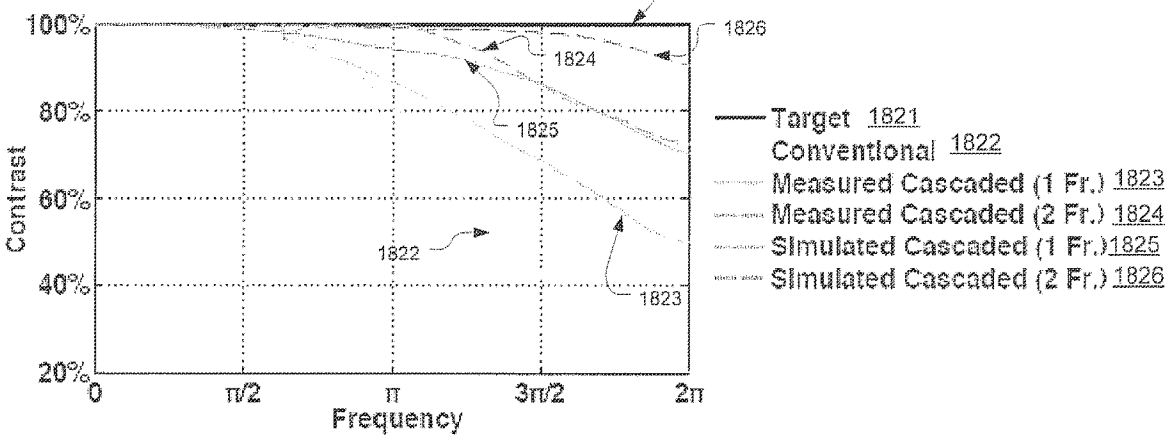
FIG. 18B shows the measured modulation transfer function for an exemplary cascaded LCD display device.

FIG. 18B shows the measured modulation transfer function for an exemplary cascaded LCD display device. The cascaded display device achieves clear superresolution when compared to a conventional display. FIG. 18B shows the measured MTF from the cascaded LCD display device for 1 and 2 frame factorizations. While the MTF is lower than predicted in simulation, it offers a clear improvement over a conventional display.

FIG. 19 is a chart comparing Peak signal-to-noise (PSNR) in [dB] for a set of natural images obtained in various superresolution techniques according to the prior art and cascaded displays according to the present disclosure. FIG. 20 is a chart showing structural similarity index (SSIM) as a sum over all color channels for a set of natural images obtained in various superresolution techniques according to the prior art and cascaded displays according to the present disclosure.

Three alternatives are compared: additive superresolution displays using either two or four frames, optical pixel sharing (OPS) using two frames, and cascaded displays using one, two, three and four frames. Additive superresolution uses a single display layer, whereas OPS and cascaded displays employ two display layers. Two versions are included for OPS. In one OPS version, its edge-threshold is optimized and used $1/\epsilon=8$ for smoothing. In the second OPS version, both the edge-threshold and the smoothing parameter $1/\epsilon$ are optimized. For the optimization of the optimal parameters for this image set, the average PSNR in the last row of this table is used as the objective function. For the table on the right (in grey) OPS parameters are optimized per image for the best achievable quality.

The data demonstrates that single-frame cascaded displays achieve a better quality than two-frame additive superresolution displays, both in terms of PSNR and SSIM. Cascaded displays achieve roughly the quality of a two-frame OPS display: the average PSNR of single-frame cascaded displays is slightly less than for the jointly optimized OPS (our improvement to the original OPS paper), but our average single-frame SSIM is slightly better than jointly optimized OPS. The cascaded displays with two or more frames outperform all other methods by significant margins.

Figure 21B:
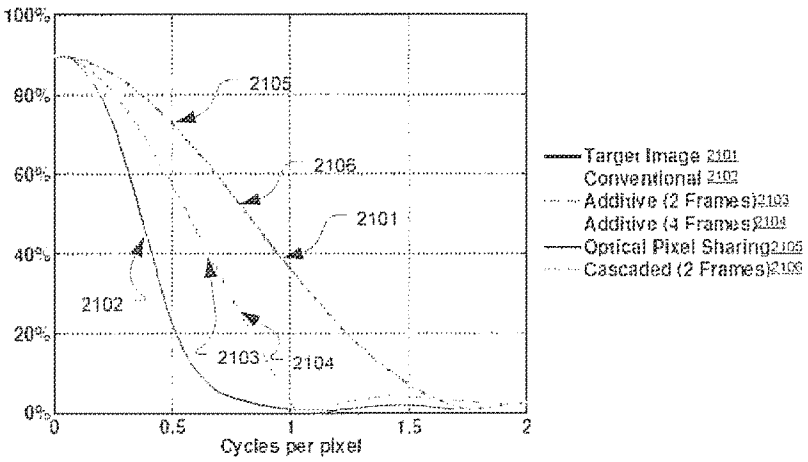
FIG. 21B shows slanted edge MTF measurements for the different methods presented in FIG. 21A.
Figure 21A:
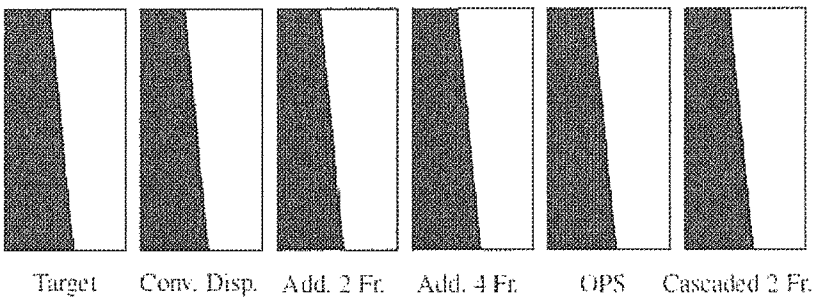
FIG. 21A shows slanted edges of target image, conventional display, additive displays with 2 and 4 frames, OPS, and cascaded displays (rank-2)

FIG. 21A shows slanted edges of target image, conventional display, additive displays with 2 and 4 frames, OPS, and cascaded displays (rank-2). FIG. 21B shows slanted edge MTF measurements for the different methods presented in FIG. 21A.

MTFs are computed using the slanted edge method. In this case, the MTF is estimated from the profile of the slanted edge. Note the slanted edge MTF of the cascaded display matches the MTF of the target image. OPS reproduces the slanted edge very well, since there is enough pixel intensity in the bright regions that it can redistribute to the edge.

Figure 22:
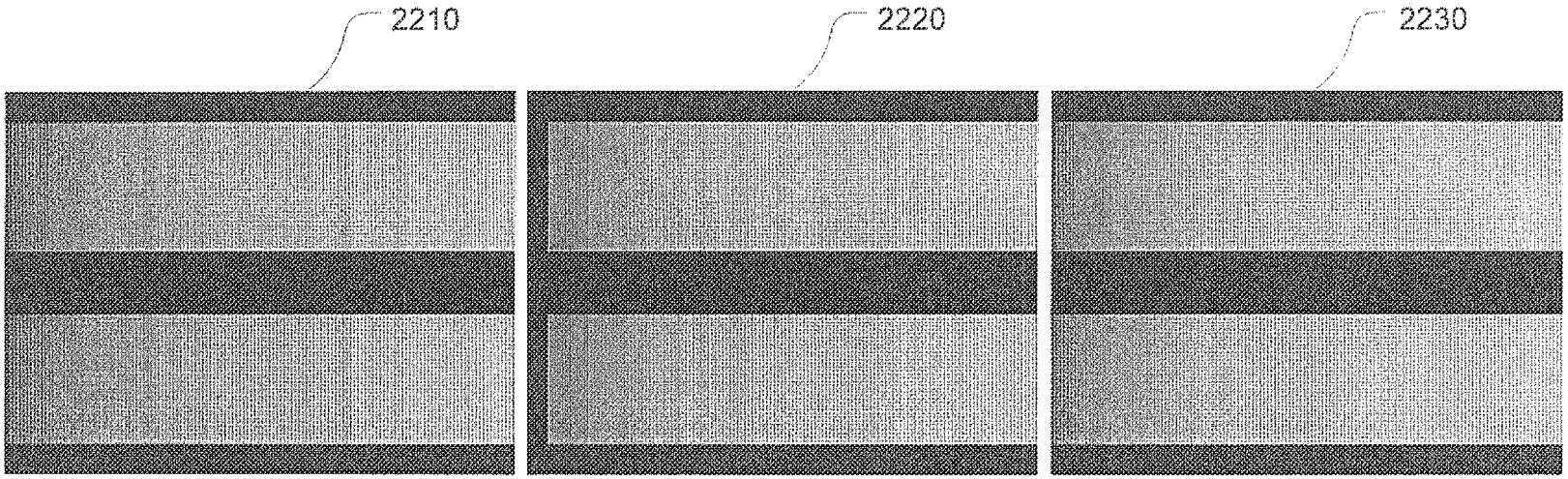
FIG. 22 presents the appearance of a linear ramp using a pair of exemplary 8-bit cascaded displays to demonstrate HDR applications of cascaded displays according to an embodiment of the present disclosure.

FIG. 22 presents the appearance of a linear ramp using a pair of exemplary 8-bit cascaded displays to demonstrate HDR applications of cascaded displays according to an embodiment of the present disclosure. A target ramp (2210) is presented with a single 8-bit display (2220) and a cascaded display using two 8-bit layers (2230). The results demonstrate that cascaded displays can also increase the dynamic range. As observed through results presented above, reconstruction artifacts due to compression are nearly eliminated by adopting two-frame factorizations.

Figure 23B:
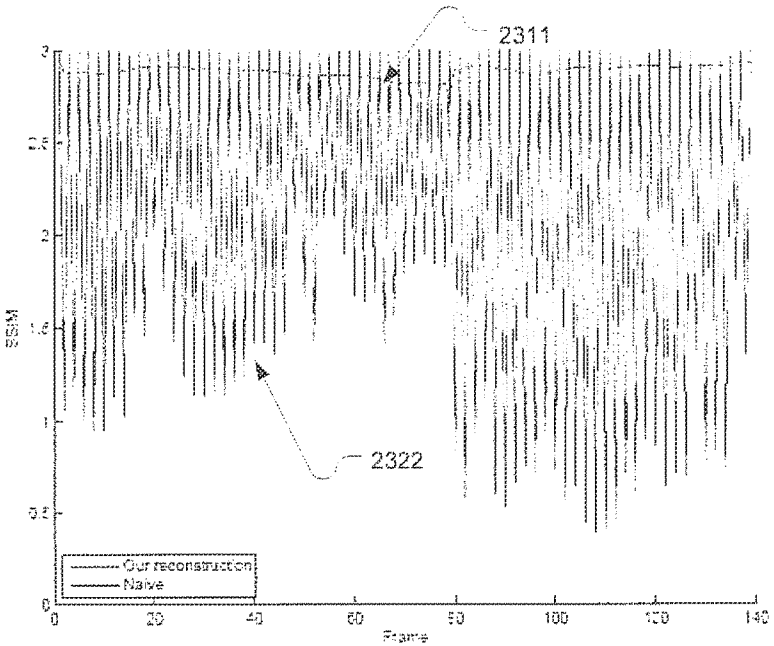
FIG. 23B shows data plots to compare the quality of temporal superresolution vs. the lower frame rate in terms of SSIM.
Figure 23A:
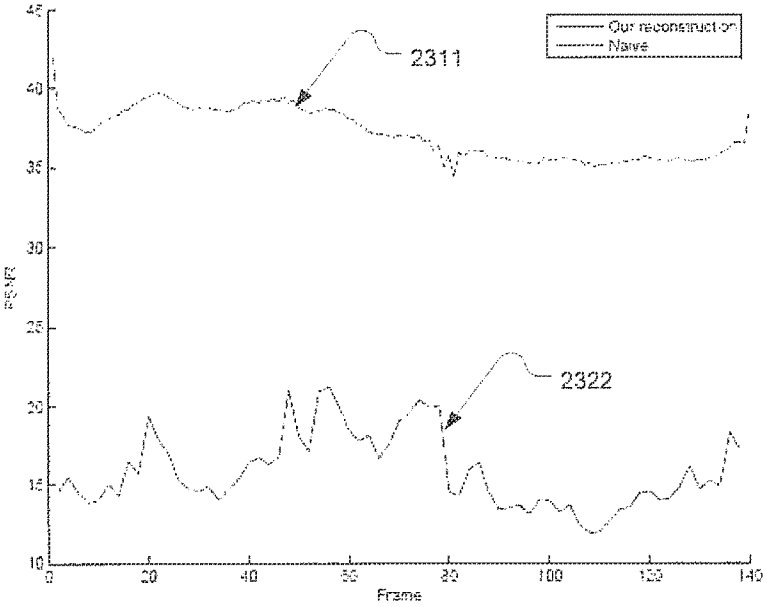
FIG. 23A shows data plots to compare the quality of temporal superresolution vs. the lower frame rate in terms of PSNR on a natural movie.

FIG. 23A shows data plots to compare the quality of temporal superresolution (plot 2311) vs. the lower frame rate (plot 2312) in terms of peak signal noise ratio (PSNR) on a natural movie. FIG. 23B shows data plots to compare the quality of temporal superresolution (plot 2322) vs. the lower frame rate (plot 2322) in terms of structural similarity (SSIM). PSNR and SSIM are computed between the target video at superresolved frame rates and the normal frame rate (i.e., low-frame rate) video.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A method of displaying images, said method comprising:

accessing original image data representing are image;

factorizing said original image data into first image data and second image data, wherein said original image data is substantially proportional to a multiplication product of said first image data and said second image data; and displaying a representation of said image on a display device at an effective display resolution, wherein said display device comprises a first display layer having a first native resolution and a second display layer having a second native resolution, wherein said first display layer overlays said second display layer, wherein said factorizing said original image data is based on a geometric relationship between said first display layer and said second display layer, and wherein said displaying comprises:

rendering said first image data for display on said first display layer; and rendering said second image data for display on said second display layer, and wherein further said effective display resolution is greater than said first native resolution and said second native resolution.

2. The method of claim 1, wherein said display device comprises L display layers that comprise said first display layer and said second display layer, wherein L is an integer value greater than 1, and wherein further a respective display layer of said L display layers is laterally offset relative to an immediately adjacent display layer by 1/L pixel in two directions.

3. The method of claim 2, wherein said displaying comprises modulating a pixel in said respective display layer using multiple pixels of an underlying display layer in said L display layers.

4. The method of claim 2, wherein said first image data corresponds to a single frame of said image, and wherein said second image data corresponds to a single frame of said image.

5. The method of claim 1, wherein said original image data represent a single frame of pixels of said image, wherein said first image data represents a first plurality of frames of pixels of said image, wherein said second image data represent a second plurality of frames of pixels of said image, wherein said rendering said first image data comprises consecutively rendering said first plurality of frames, and wherein further said rendering said second image data comprises consecutively rendering said second plurality of frames.

6. The method of claim 5, wherein said first plurality of frames are rendered on said first display layer in synchronization with said second plurality of frames being rendered on said second display layer.

7. The method of claim 5, wherein a frame refresh time during rendering said first plurality of frames is offset from a frame refresh time during rendering said second plurality of frames by a fraction of a frame refresh cycle of said first display layer.

8. The method of claim 1, wherein said factorizing comprises deriving said first image data and said second image data in accordance with an iteration process.

9. The method of claim 1, wherein said factorizing further comprises accessing a weight matrix that is generated based on at least one of: relative lateral position between said first display layer and said second display layer; vertical position between said first display layer and said second display layer; in-plane rotations between said first display layer and said second display layer; and brightness attenuation, and wherein said multiplication product corresponds to a matrix representing said first image data multiplied by a transposed matrix representing said second image data.

10. A method of displaying images comprising:

accessing first frames representing one frame of an image in a first spatial resolution;

accessing second frames representing said one frame of said image in a second spatial resolution;

sequentially rendering said first frames for display on a first display layer of a display device;

sequentially rendering said second frames for display on a second display layer of said display device, wherein said first display layer overlays said second display layer with a lateral shift in two directions by a fraction of a pixel of said first display layer, wherein data of said first frames and data of said second frames are derived by factorizing original image data based on a geometric relationship between said first display layer and said second display layer, wherein said original image data is substantially proportional to a multiplication product of said data of said first frame and, said data of said second frames, and wherein further said sequentially renderings result in an effective display resolution of said one frame of said image on said display device, wherein said effective display resolution is greater than said first spatial resolution and said second spatial resolution.

11. The method of claim 10 further comprising:

accessing said original image data representing said one frame of image in an original spatial resolution, wherein said original spatial resolution is greater than said first spatial resolution and said second spatial resolution, wherein said factorizing said original image data is performed in accordance with an iteration method, and wherein said first frames comprise four frames and said second frames comprise four frames.

12. The method of claim 10, wherein said first frames and said second frames each comprise a same number of frames, and wherein further said first frames and said second frames are rendered on said first display layer and said second display layer in synchronization with respect to frame refresh time.

13. The method of claim 10, wherein a frame refresh time for rendering said first frames is temporally offset from a frame refresh time for rendering said second frames by a half frame refresh period.

14. The method of claim 10, wherein said display device comprises L display layers, wherein L is an integer greater than 1, and wherein said fraction of a pixel equals 1/L pixel.

15. A display system comprising:

a plurality of display layers disposed in a cascaded manner and comprising a first display layer and a second display layer, wherein said first display layer offsets by a fraction of a pixel with reference to said second display layer in two orthogonal lateral directions:

a processor coupled to said plurality of display layers;

memory coupled to said processor and comprising instructions that, when executed by said processor, implement a method of displaying a representation of an image, said method comprising:

accessing first image data representing said image and second image data representing said image, wherein said first image data and said second image data are derived by factorizing original image data based on a geometric relationship between said first display layer and said second display layer, wherein said original image data is substantially proportional to a multiplication product of said first image data and said second image data;

rendering said first image data for display on said first display layer at a first spatial resolution; and rendering said second image data for display on said second display layer at a second spatial resolution, wherein further an effective display resolution of said representation of said image is greater than said first native spatial resolution and said second native spatial resolution.

16. The display system of claim 15, wherein said first image data represents a first plurality of frames of said image, wherein said second image data represents a second plurality of frames of said image, wherein said rendering said first image data comprises sequentially rendering said first plurality of frames in synchronization with sequentially rendering said second plurality of frames.

17. The display system of claim 15, wherein said first image data represents a first plurality of frames of said image, wherein said second image data represents a second plurality of frames of said image, wherein said first plurality of frames and said second plurality of frames are respectively refreshed at staggered intervals of a same refresh rate.

18. The display system of claim 15, wherein said fraction of a pixel equals half a pixel.

19. The display system of claim 15, wherein said method further comprises:

accessing said original data representing said image in a single frame in an original resolution that is greater than said first spatial resolution and said second spatial resolution, and wherein said factorizing said original data is performed using a multiplicative updating process.

20. The display system of claim 15 further comprising color filter arrays coupled to said plurality of display layers, wherein said plurality of display layers comprise liquid crystal panels (LCDs) of a flat panel display, a mixture of multiple types of display panels or liquid crystal on silicon (LCoS) panels of a digital projector.

* * * * *